US007751760B2

(12) United States Patent
Koike et al.

(10) Patent No.: US 7,751,760 B2
(45) **Date of Patent: *Jul. 6, 2010**

(54) IMAGE FORMING APPARATUS, IMAGE FORMING METHOD, AND IMAGE FORMING SYSTEM

(75) Inventors: Naoki Koike, Suwa (JP); Hiroshi Kato, Suwa (JP); Shinichi Kamoshida, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 734 days.

This patent is subject to a terminal disclaimer.

(21) Appl. No.: 11/678,939

(22) Filed: Feb. 26, 2007

(65) Prior Publication Data

US 2007/0206240 A1 Sep. 6, 2007

(30) Foreign Application Priority Data

Mar. 2, 2006 (JP) ..... 2006-056831
Nov. 1, 2006 (JP) ..... 2006-297695

(51) Int. Cl.
*G03G 15/08* (2006.01)

(52) U.S. Cl. ..... 399/285; 399/286

(58) Field of Classification Search ..... 399/53, 399/55, 235, 240, 270, 276, 279, 284–286
See application file for complete search history.

(56) References Cited

U.S. PATENT DOCUMENTS 4,780,741 A * 10/1988 Wada et al.
5,311,263 A * 5/1994 Suzuki et al. ..... 399/276
5,451,713 A * 9/1995 Suzuki et al. ..... 399/285
5,502,552 A * 3/1996 Iwata et al.
6,708,015 B2 3/2004 Kurosu et al.
6,889,024 B2 * 5/2005 Shiraki et al.
2006/0039719 A1 * 2/2006 Tokumasu et al.
2007/0110484 A1 * 5/2007 Yamada et al. ..... 399/286

FOREIGN PATENT DOCUMENTS

JP 04-145472 5/1992
JP 04-240671 8/1992
JP 05-142950 6/1993
JP 06-083150 3/1994
JP 06-083150 A 3/1994
JP 06083150 A * 3/1994
JP 07013410 A * 1/1995
JP 07-077867 3/1995
JP 2000-098708 4/2000

(Continued)

*Primary Examiner*—David P Porta
*Assistant Examiner*—Milton Gonzalez
(74) *Attorney, Agent, or Firm*—Hogan Lovells US LLP

(57) ABSTRACT

An image forming apparatus includes a developer bearing member for transporting developer to an opposing position opposing an image bearing member. Regularly-disposed concave sections are formed on a surface of the developer bearing member. An alternating voltage that includes a first voltage for moving developer from the developer bearing member toward the image bearing member, and a second voltage for moving developer from the image bearing member toward the developer bearing member is applied to the developer bearing member. A cycle period of the alternating voltage is larger than a minimum width of the concave section in a circumferential direction of the developer bearing member divided by a moving velocity of a surface of the rotating developer bearing member.

12 Claims, 20 Drawing Sheets

FOREIGN PATENT DOCUMENTS

| | | | |
|---|---|---|---|
| JP | 2000-098708 | A | 4/2000 |
| JP | 2002014539 | A | 1/2002 |
| JP | 2002278278 | A | 9/2002 |
| JP | 2003084574 | A | 3/2003 |
| JP | 2003-208012 | | 7/2003 |
| JP | 2003-208012 | A | 7/2003 |
| JP | 2003263033 | A | 9/2003 |
| JP | 2004-219640 | | 8/2004 |

* cited by examiner

| TYPE OF MEDIUM | V | T1 | T2 |
|---|---|---|---|
| PLAIN PAPER | 300mm/s | 0.3ms | 1.0ms |
| THICK PAPER | 225mm/s | 0.4ms | 1.1ms |
| OHP TRANSPARENCY | 150mm/s | 0.5ms | 1.2ms |

FIG. 18

IMAGE FORMING APPARATUS, IMAGE FORMING METHOD, AND IMAGE FORMING SYSTEM

CROSS-REFERENCE TO RELATED APPLICATIONS

The present application claims priority upon Japanese Patent Application No. 2006-56831 filed on Mar. 2, 2006, and Japanese Patent Application No. 2006-297695 filed on Nov. 1, 2006, which are herein incorporated by reference.

BACKGROUND

1. Technical Field

The present invention relates to image forming apparatuses, image forming methods and image forming systems.

2. Related Art

Image forming apparatuses such as laser beam printers are already well known. Such image forming apparatuses include, for example, an image bearing member for bearing latent images, and a developer bearing member for transporting developer to an opposing position opposing the image bearing member by rotating with developer being borne thereon. When image signals or the like are transmitted from an external apparatus such as a host computer, latent images borne on the image bearing member are developed using the developer that has been transported to the opposing position by the developer bearing member, thereby forming developer images. Then, the developer images are transferred onto a medium so as to ultimately form images on the medium.

During development of the latent images using developer, some of such image forming apparatuses apply to the developer bearing member an alternating voltage that includes a first voltage for moving a developer from the developer bearing member toward the image bearing member, and a second voltage for moving developer from the image bearing member toward the developer bearing member. In addition, regularly disposed concave sections are sometimes provided on the surface of such a developer bearing member such that a sufficient amount of developer is borne on the surface of the developer bearing member (in other words, in order to ensure a sufficiently large surface area for the surface on which developer is borne), or for other reasons.

Incidentally, in such an image forming apparatus, a discharge phenomenon may occur between the image bearing member and the developer bearing member during development of the latent images. When a discharge phenomenon occurs, developer images are not appropriately formed on the image bearing member, and ultimately defective images are formed on a medium.

JP-A-5-142950 and JP-A-2004-219640 disclose examples of related technique.

SUMMARY

The invention was achieved to address the above-described problems, and the advantage thereof is to appropriately suppress occurrence of the discharge phenomenon.

A primary aspect of the invention is an image forming apparatus such as the following.

An image forming apparatus including:

an image bearing member for bearing a latent image;

a developer bearing member for transporting developer to an opposing position opposing the image bearing member by rotating with developer being borne thereon, the developer bearing member having regularly-disposed concave sections formed on a surface thereof; and an alternating voltage applying section for applying to the developer bearing member an alternating voltage that includes a first voltage for moving developer from the developer bearing member toward the image bearing member and a second voltage for moving developer from the image bearing member toward the developer bearing member in order to develop the latent image using the developer that has been transported to the opposing position, wherein a cycle period of the alternating voltage is larger than a value obtained by dividing a minimum width of the concave section in a circumferential direction of the developer bearing member by a moving velocity of a surface of the developer bearing member during rotation of the developer bearing member.

Other features of the invention will become clear through the accompanying drawings and the following description.

BRIEF DESCRIPTION OF THE DRAWINGS

For a more complete understanding of the invention and the advantages thereof, reference is now made to the following description taken in conjunction with the accompanying drawings.

FIG. 18 is a table showing the relationship between the type of media and a moving velocity V of the developing roller 510 and the like, FIG. 19A is a schematic view showing a transitional state (1) of the developing roller 510 during the manufacturing process of the developing roller 510.

DESCRIPTION OF EXEMPLARY EMBODIMENTS

Figure 1:
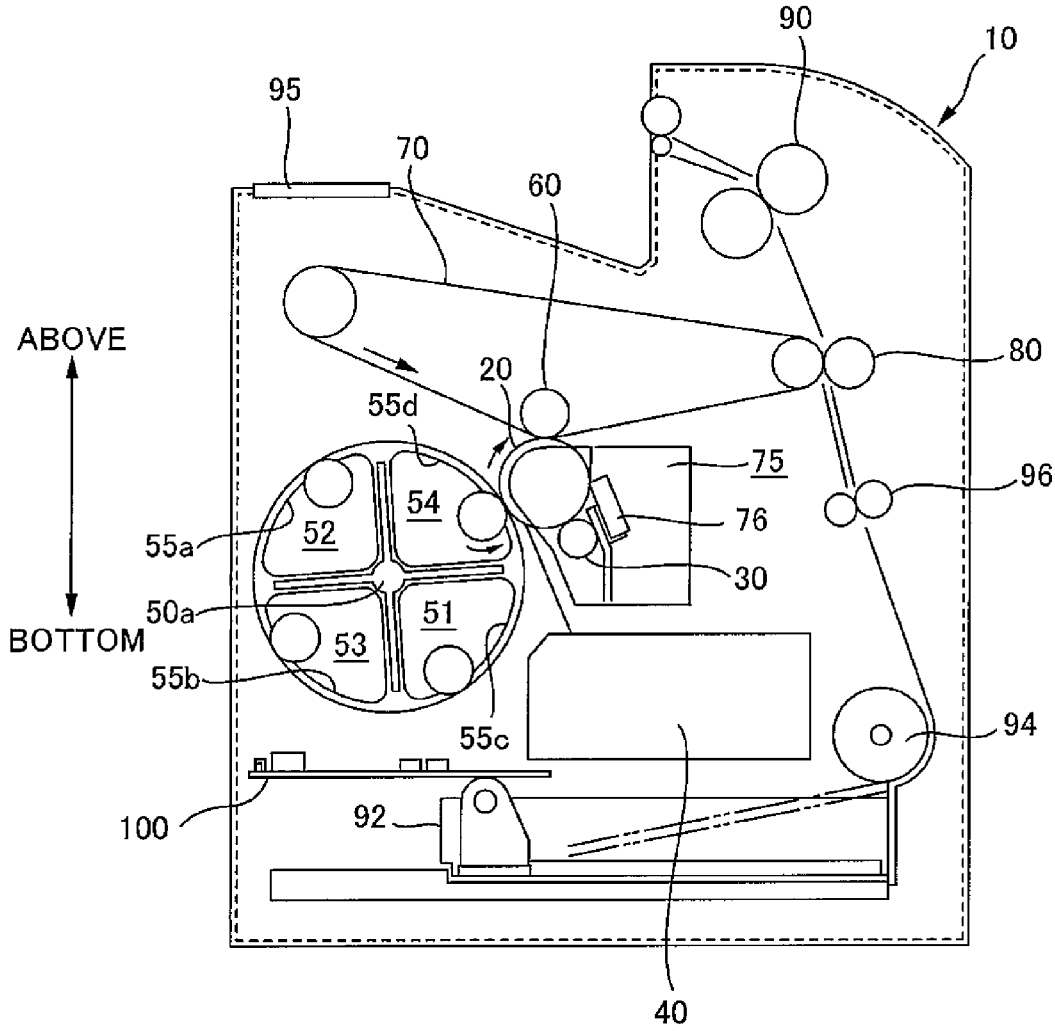
FIG. 1 is a diagram showing the main structural components constituting a printer 10.

At least the following matters will be made clear by the explanation in the present specification and the description of the accompanying drawings.

An image forming apparatus including:

an image bearing member for bearing a latent image;

a developer bearing member for transporting developer to an opposing position opposing the image bearing member by rotating with developer being borne thereon, the developer bearing member having regularly-disposed concave sections formed on a surface thereof; and an alternating voltage applying section for applying to the developer bearing member an alternating voltage that includes a first voltage for moving developer from the developer bearing member toward the image bearing member and a second voltage for moving developer from the image bearing member toward the developer bearing member in order to develop the latent image using the developer that has been transported to the opposing position, wherein a cycle period of the alternating voltage is larger than a value obtained by dividing a minimum width of the concave section in a circumferential direction of the developer bearing member by a moving velocity of a surface of the developer bearing member during rotation of the developer bearing member.

With such an image forming apparatus, it is possible to appropriately suppress occurrence of the discharge phenomenon.

In such an image forming apparatus, the concave section may be composed of two kinds of helical groove sections that have different inclination angles with respect to the circumferential direction, and the two kinds of helical groove sections may mutually intersect so as to form a grid pattern.

In such an image forming apparatus, the developer bearing member may include a rhomboid-shaped top surface surrounded by the two kinds of helical groove sections, and one of two diagonal lines of the rhomboid-shaped top surface may be along the circumferential direction.

In such an image forming apparatus, the developer bearing member may include a square-shaped top surface surrounded by the two kinds of helical groove sections.

In such an image forming apparatus, the voltage that the alternating voltage applying section applies to the developer bearing member may be only the first voltage and the second voltage, and the alternating voltage applying section alternately may apply the first voltage and the second voltage.

In such an image forming apparatus, the moving velocity may be variable, and when the moving velocity is changed, the cycle period of the alternating voltage may be changed so that the cycle period of the alternating voltage is larger than a value obtained by dividing the minimum width by the moving velocity.

In such a case, regardless of the operational mode of the image forming apparatus, the above-described effect, that is, appropriate suppression of occurrence of the discharge phenomenon, is achieved.

Such an image forming apparatus may further include a charging member opposing the image bearing member for charging the image bearing member, and a superimposed voltage applying section for applying to the charging member a superimposed voltage in which a DC voltage and an AC voltage are superimposed, and the cycle period of the alternating voltage may be different from both of a value obtained by multiplying a cycle period of the superimposed voltage by any positive integer, and a value obtained by dividing the cycle period by any positive integer.

In such a case, in addition to appropriate suppression of occurrence of the discharge phenomenon, since the cycle period of the alternating voltage is different from both of a value obtained by multiplying the cycle period of the superimposed voltage by any positive integer, and a value obtained by dividing the cycle period by any positive integer, it is possible to prevent occurrence positions of two types of uneven density from coinciding in succession. Therefore, conspicuous uneven density in images can be prevented.

In such an image forming apparatus, the charging member may be a charging roller that is rotatable, and the charging roller may oppose the image bearing member with a gap therebetween.

In such a case, the effect of suppressing conspicuous uneven density in images can be achieved more effectively.

In such an image forming apparatus, the image bearing member may be rotatable, the alternating voltage applying section may alternately apply the first voltage and the second voltage for a predetermined period, and when a portion of the image bearing member that is positioned at a charging position for charging with the charging member when the superimposed voltage applying section starts applying the superimposed voltage, reaches a developing position for developing using the developer transported to the opposing position through rotation of the image bearing member, the alternating voltage applying section may start applying one of the first voltage and the second voltage to the developer bearing member.

In such a case, the effect of suppressing conspicuous uneven density in images can be achieved more effectively.

In such an image forming apparatus, the concave section may be composed of two kinds of helical groove sections that have different inclination angles with respect to the circumferential direction, and the two kinds of helical groove sections may mutually intersect so as to form a grid pattern, the developer bearing member may include a square-shaped top surface surrounded by the two kinds of helical groove sections, and one of two diagonal lines of the square-shaped top surface may be along the circumferential direction.

An image forming method including:

changing a moving velocity of a surface of a developer bearing member during rotation of the developer bearing member, the developer bearing member being for transporting developer to an opposing position opposing an image bearing member by rotating with developer being borne thereon, and including regularly-disposed concave sections formed on the surface thereof, changing a cycle period of an alternating voltage that includes a first voltage for moving developer from the developer bearing member toward the image bearing member and a second voltage for moving developer from the image bearing member toward the developer bearing member so that the cycle period of the alternating voltage is larger than a value obtained by dividing a minimum width of the concave section in a circumferential direction of the developer bearing member by the moving velocity after change, changing a cycle period of a superimposed voltage in which a DC voltage and an AC voltage are superimposed, such that the cycle period after change of the alternating voltage are different from both of a value obtained by multiplying the changed cycle period of the superimposed voltage by any positive integer, and a value obtained by dividing the changed cycle period by any positive integer, charging the image bearing member by applying the superimposed voltage, whose cycle period has been changed, to a charging member opposing the image bearing member, and developing a latent image borne on the image bearing member using the developer that has been transported to the opposing position by applying the alternating voltage, whose cycle period has been changed, to the developer bearing member.

With such an image forming method, even if the moving velocity of the developer bearing member is changed, it is possible to appropriately suppress occurrence of the discharge phenomenon and suppress conspicuous uneven density in images.

In such a method, types of media on which an image can be formed may be plain paper and thick paper, and when forming an image on the plain paper, the moving velocity of the surface of the developer bearing member may be increased, and when forming an image on the thick paper, the moving velocity of the surface of the developer bearing member may be decreased.

In such a case, even if the type of the medium is changed, it is possible to appropriately suppress occurrence of the discharge phenomenon and suppress conspicuous uneven density in images.

An image forming system including:

a computer; and an image forming apparatus that can be connected to the computer, including an image bearing member for bearing a latent image, a developer bearing member for transporting developer to an opposing position opposing the image bearing member by rotating with developer being borne thereon, the developer bearing member having regularly-disposed concave sections formed on a surface thereof, and an alternating voltage applying section for applying to the developer bearing member an alternating voltage that includes a first voltage for moving developer from the developer bearing member toward the image bearing member, and a second voltage for moving developer from the image bearing member toward the developer bearing member in order to develop the latent image using the developer that has been transported to the opposing position, wherein a cycle period of the alternating voltage is larger than a value obtained by dividing a minimum width of the concave section in a circumferential direction of the developer bearing member by a moving velocity of a surface of the developer bearing member during rotation of the developer bearing member.

With such an image forming system, it is possible to appropriately suppress occurrence of the discharge phenomenon.

Overall Configuration Example of the Image Forming Apparatus

Next, using FIG. 1, an outline of a laser beam printer (hereinafter, also referred to as the "printer") 10 serving as an example of an image forming apparatus is described. FIG. 1 is a diagram showing the main structural components constituting the printer 10. It should be noted that in FIG. 1, the vertical directions are indicated by the arrows, and, for example, a paper supply tray 92 is arranged at a lower portion of the printer 10 and a fixing unit 90 is arranged at an upper portion of the printer 10.

As shown in FIG. 1, the printer 10 according to the present embodiment includes a charging unit 30, an exposing unit 40, a YMCK developing unit 50, a primary transfer unit 60, an intermediate transfer member 70, and a cleaning unit 75. These units are arranged in the direction of rotation of a photoconductor 20, which serves as an example of an image bearing member for bearing latent images. The printer 10 further includes a secondary transfer unit 80, a fixing unit 90, a display unit 95 constituted by a liquid-crystal panel and serving as a means for making notification to the user, and a control unit 100 for controlling these units and the like so as to manage the operations of the printer.

The photoconductor 20 has a cylindrical conductive base material and a photoconductive layer formed on the outer peripheral surface of the conductive base material, and is rotatable about a central axis thereof. In the present embodiment, the photoconductor 20 rotates clockwise, as shown by the arrow in FIG. 1.

The charging unit 30 is a device for charging the photoconductor 20. The charging unit 30 is described in detail later. The exposing unit 40 is a device for forming latent images on the photoconductor 20 that is charged by laser irradiation. The exposing unit 40 has, a semiconductor laser, a polygon mirror, an F-θ lens and the like and irradiates the charged photoconductor 20 with a modulated laser beam according to image signals that have been input from a unshown host computer such as a personal computer or a word processor.

The YMCK developing unit 50 is a device for developing a latent image formed on the photoconductor 20 using a toner, which is an example of developer contained in developing devices, that is, a black (K) toner contained in a black developing device 51, a magenta (M) toner contained in a magenta developing device 52, a cyan (C) toner contained in a cyan developing device 53, and a yellow (Y) toner contained in a yellow developing device 54.

By rotating the YMCK developing unit 50 in a state in which the four developing devices 51, 52, 53, and 54 are mounted, it is possible to move the positions of these four developing devices 51, 52, 53, and 54. More specifically, the YMCK developing unit 50 holds the four developing devices 51, 52, 53 and 54 with four holding sections 55*a*, 55*b*, 55*c* and 55*d*. The four developing devices 51, 52, 53 and 54 can be rotated about a central shaft 50*a*, while maintaining their relative positions. Every time the image formation for one page is finished, a different one of the developing devices is caused to selectively oppose the photoconductor 20, thereby successively developing latent images formed on the photoconductor 20 with the toners contained in each of the developing devices 51, 52, 53, and 54. It should be noted that the four respective developing devices 51, 52, 53 and 54 can be attached to and detached from the holding sections of the YMCK developing unit 50. Details of the developing devices are described further below.

The primary transfer unit 60 is a device for transferring, onto the intermediate transfer member 70, single-color toner images formed on the photoconductor 20. When toners of four colors are successively transferred in a superimposed manner, a full-color toner image is formed on the intermediate transfer member 70. The intermediate transfer member 70 is an endless belt that is made by providing a tin-deposited layer on the surface of a PET film, and forming and laminating on the layer surface a semiconductive coating. The intermediate transfer member 70 is driven to rotate at substantially the same circumferential speed as the photoconductor 20.

The secondary transfer unit 80 is a device for transferring the single-color toner image or the full-color toner image formed on the intermediate transfer member 70 onto a medium such as paper, film, and cloth. The fixing unit 90 is a device for fusing the single-color toner image or the full-color toner image, which has been transferred onto the medium, onto the medium to turn it into a permanent image.

The cleaning unit 75 is provided between the primary transfer unit 60 and the charging unit 30, and has a rubber cleaning blade 76 that contacts against the surface of the photoconductor 20. It is a device for removing the toner remaining on the photoconductor 20 by scraping it off with the cleaning blade 76 after the toner image has been transferred onto the intermediate transfer member 70 by the primary transfer unit 60.

Figure 2:
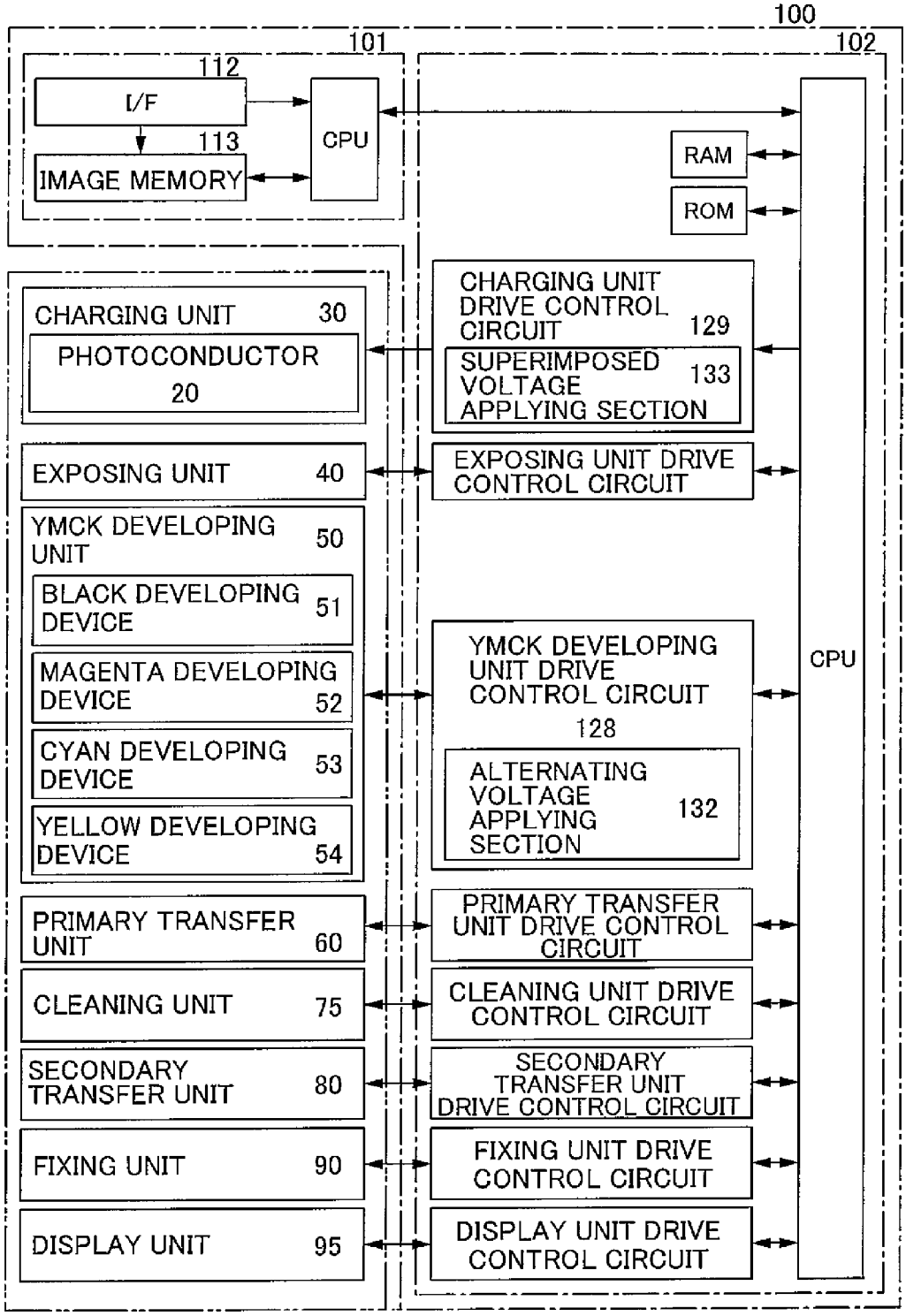
FIG. 2 is a block diagram showing a control unit of the printer 10 in FIG. 1.

The control unit 100 is constituted by a main controller 101 and a unit controller 102, as shown in FIG. 2. Image signals and control signals are input to the main controller 101, and in accordance with commands based on these image signals and control signals, the unit controller 102 controls the various units or the like in order to form the image.

Next, the operation of the printer 10 configured as above is described.

First, image signals and control signals from a host computer that is not shown are input to the main controller 101 of the printer 10 via an interface (I/F) 112. Then, the photoconductor 20 and the intermediate transfer member 70 are rotated due to control by the unit controller 102 based on the command from the main controller 101. While rotating, the photoconductor 20 is successively charged by the charging unit 30 at a charging position.

With the rotation of the photoconductor 20, the charged area of the photoconductor 20 reaches an exposing position. A latent image that corresponds to image information for the first color, for example, yellow Y, is formed in that area by the exposing unit 40. The YMCK developing unit 50 positions the yellow developing device 54, which contains yellow (Y) toner, at a developing position opposing the photoconductor 20. With the rotation of the photoconductor 20, the latent image formed on the photoconductor 20 reaches the developing position, and is developed using the yellow toner by the yellow developing device 54. Thus, a yellow toner image is formed on the photoconductor 20. With the rotation of the photoconductor 20, the yellow toner image formed on the photoconductor 20 reaches a primary transfer position, and is transferred onto the intermediate transfer member 70 by the primary transfer unit 60. At this time, a primary transfer voltage, which has an opposite polarity to the polarity to which the toner T is charged (negative polarity in the present embodiment), is applied to the primary transfer unit 60. It should be noted that, during this process, the photoconductor 20 and the intermediate transfer member 70 are in contact, whereas the secondary transfer unit 80 is kept separated from the intermediate transfer member 70.

By sequentially repeating the above-mentioned process with the developing devices for the second, third, and fourth colors, toner images in four colors corresponding to the respective image signals are transferred to the intermediate transfer member 70 in a superimposed manner. Thus, a full-color toner image is formed on the intermediate transfer member 70.

With the rotation of the intermediate transfer member 70, the full-color toner image formed on the intermediate transfer member 70 reaches a secondary transfer position, and is transferred onto a medium by the secondary transfer unit 80. It should be noted that the medium is transported from the paper supply tray 92 to the secondary transfer unit 80 via a paper-feed roller 94 and registration rollers 96. When transferring operation is performed, a secondary transfer voltage is applied to the secondary transfer unit 80, while being pressed against the intermediate transfer member 70.

The full-color toner image transferred onto the medium is heated and pressurized by the fixing unit 90 and fused to the medium.

On the other hand, after the photoconductor 20 passes the primary transfer position, the toner T adhering to the surface of the photoconductor 20 is scraped off by the cleaning blade 76 that is supported by the cleaning unit 75, and the photoconductor 20 is prepared for charging for forming the next latent image. The scraped-off toner T is collected into a remaining-toner collecting section of the cleaning unit 75.

Overview of the Control Unit

Next, a configuration of the control unit 100 is described with reference to FIG. 2. The main controller 101 of the control unit 100 is electrically connected to a host computer via the interface 112, and is provided with an image memory 113 for storing image signals that are input from the host computer. The unit controller 102 is electrically connected to the units in the main body of the apparatus (i.e., the charging unit 30, the exposing unit 40, the YMCK developing unit 50, the primary transfer unit 60, the cleaning unit 75, the secondary transfer unit 80, the fixing unit 90, and the displaying unit 95), and it detects the state of the units by receiving signals from sensors provided in those units, and controls them based on the signals that are input from the main controller 101.

It should be noted that a YMCK developing unit drive control circuit 128 that is connected to the YMCK developing unit 50 is provided with an alternating voltage applying section 132 (also simply referred to as the "voltage applying section"). The alternating voltage applying section 132 acts to apply an alternating voltage (hereinafter, also referred to as the "developing bias") to a developing roller 510 and form an alternating electric field between the developing roller 510 and the photoconductor 20, for developing the latent images using toners (details are described later). A charging unit drive control circuit 129 that is connected to the charging unit 30 is provided with a superimposed voltage applying section 133. The superimposed voltage applying section 133 acts to apply a superimposed voltage (hereinafter, also referred to as the "charging bias") to a charging roller 31 and forms an alternating electric field between the charging roller 31 and the photoconductor 20, for charging the photoconductor 20.

Regarding the Charging Unit 30

Figure 3A:
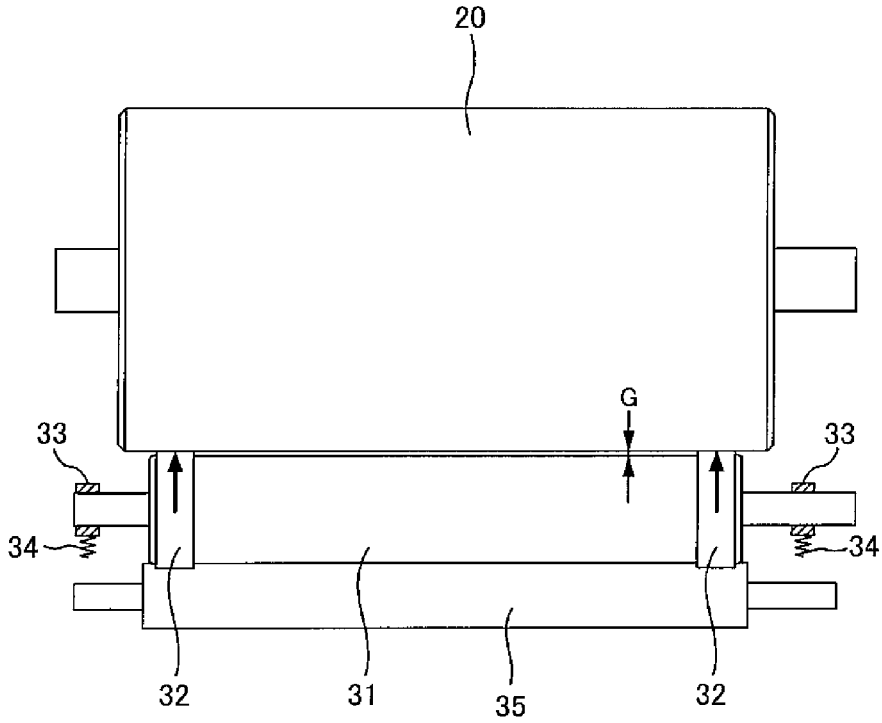
FIG. 3A is a schematic view showing a photoconductor 20 and a charging unit 30.
Figure 3B:
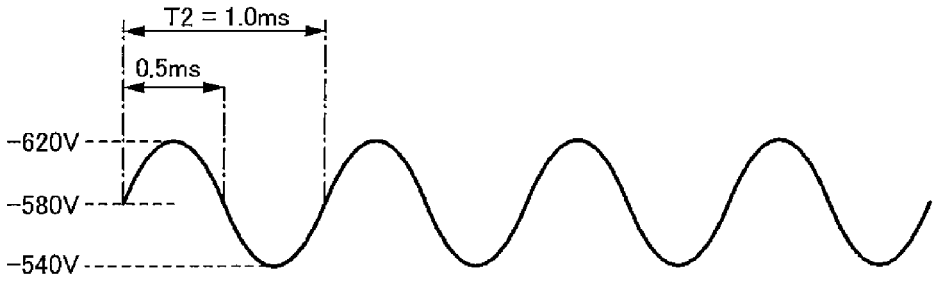
FIG. 3B is a schematic view showing a charging bias applied to a charging roller 31.

Next, the charging unit 30, which charges the photoconductor 20, is described with reference to FIGS. 3A and 3B. FIG. 3A is a schematic view showing the photoconductor 20 and the charging unit 30. FIG. 3B is a schematic view showing a superimposed voltage applied to the charging roller 31.

The charging unit 30 includes the charging roller 31 that is rotatable and serves as an example of a charging member for charging the photoconductor 20, and opposes the photoconductor 20 with a gap therebetween, and a cleaning roller 35 (not shown in FIG. 1) for cleaning the surface of the charging roller 31 by contacting against the charging roller 31. The charging roller 31 is configured by a metal shaft with conductive coating being applied on the surface thereof. In addition, a tape 32 that contacts against the photoconductor 20 is attached to the charging roller 31 at both ends in the axis direction thereof. Since the outside diameter of the tape 32 is larger than the outside diameter of the central portion of the charging roller 31, a gap G is formed between the central portion and the photoconductor 20. Therefore, the charging roller 31 charges the photoconductor 20 in a non-contacting state.

Also, the charging unit 30 includes a bearing 33 that rotatably supports the charging roller 31, and a spring 34 that biases the charging roller 31 toward the photoconductor 20 via the bearing 33. As a result of the charging roller 31 being biased by the biasing force of the spring 34 toward the photoconductor 20, the tape 32 contacts against the photoconductor 20.

Here, charging of the photoconductor 20 is described with reference to FIG. 3B. When the photoconductor 20 is charged, the superimposed voltage applying section 133 applies to the charging roller 31*a* superimposed voltage (charging bias) in which DC voltage and AC voltage are superimposed. Specifically, (AC voltage component) voltage with an amplitude range between −620 V and −540 V centering on −580 V (AC voltage component) is applied to the charging roller 31. The cycle period of the charging bias (this cycle period is referred to as "T2") is 1.0 ms (milliseconds).

Regarding the Developing Device

Figure 4:
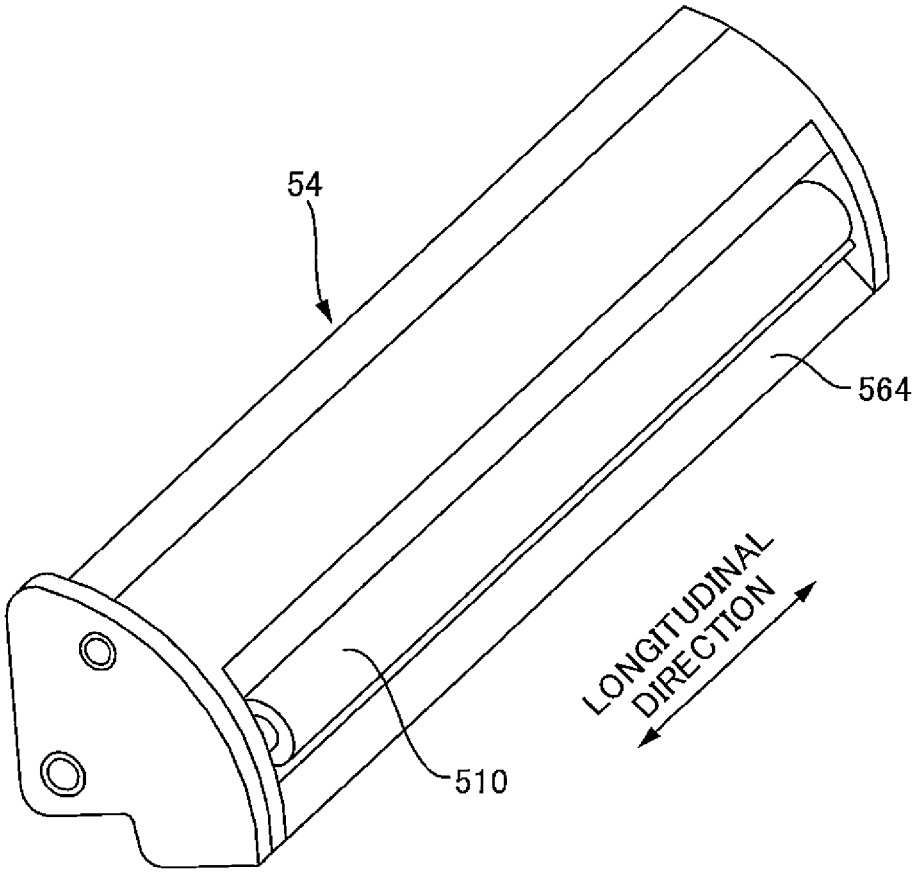
FIG. 4 is a conceptual diagram of a developing unit.
Figure 5:
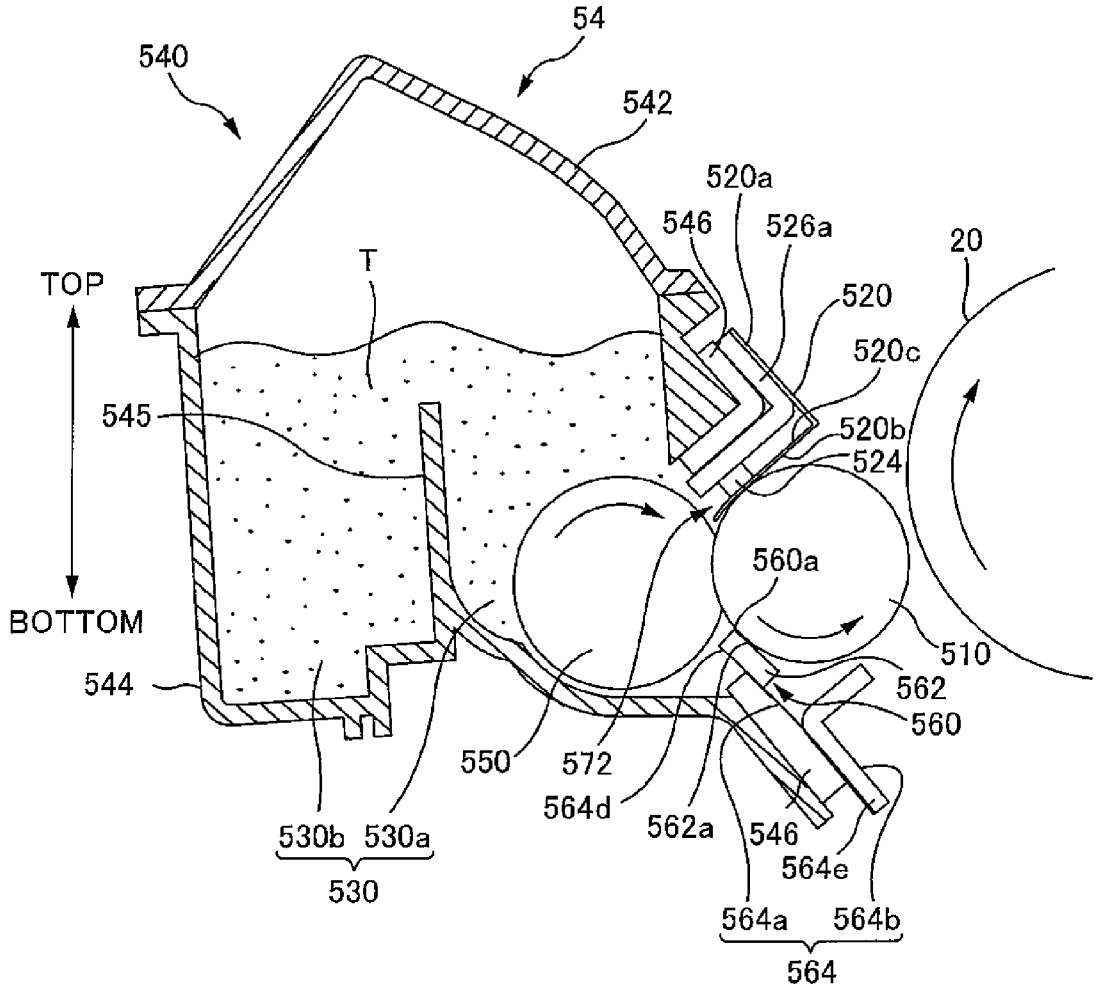
FIG. 5 is a cross-sectional view showing the main structural components of the developing unit.
Figure 6:
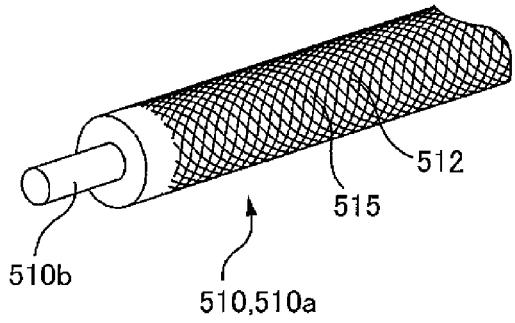
FIG. 6 is a perspective schematic view of a developing roller 510.
Figure 7:
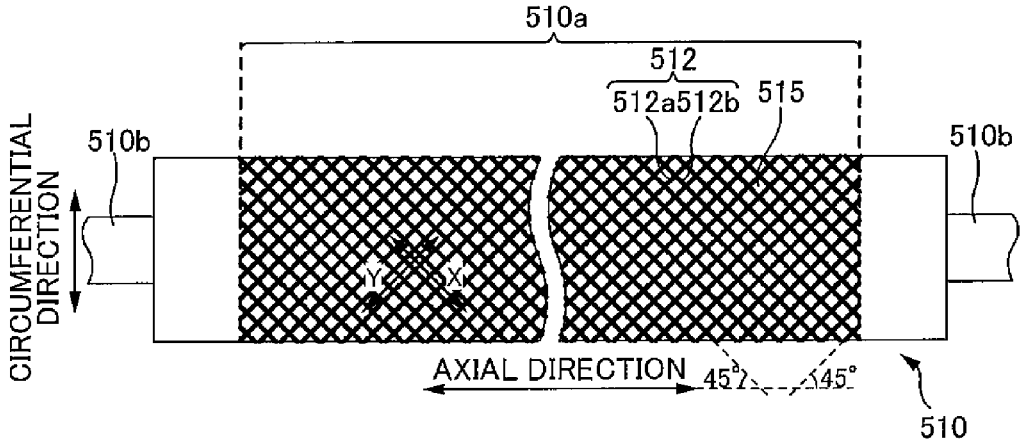
FIG. 7 is a front schematic view of the developing roller 510.
Figure 8:
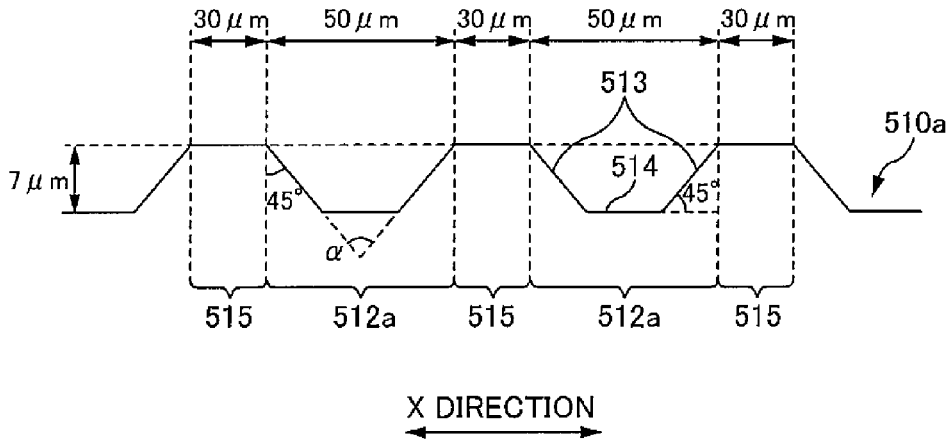
FIG. 8 is a schematic view showing the cross section of a groove section 512.
Figure 8:
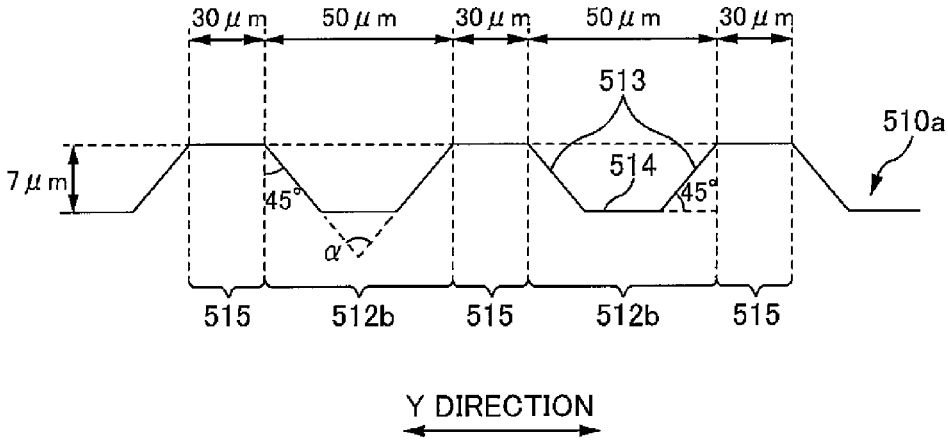
Figure 9:
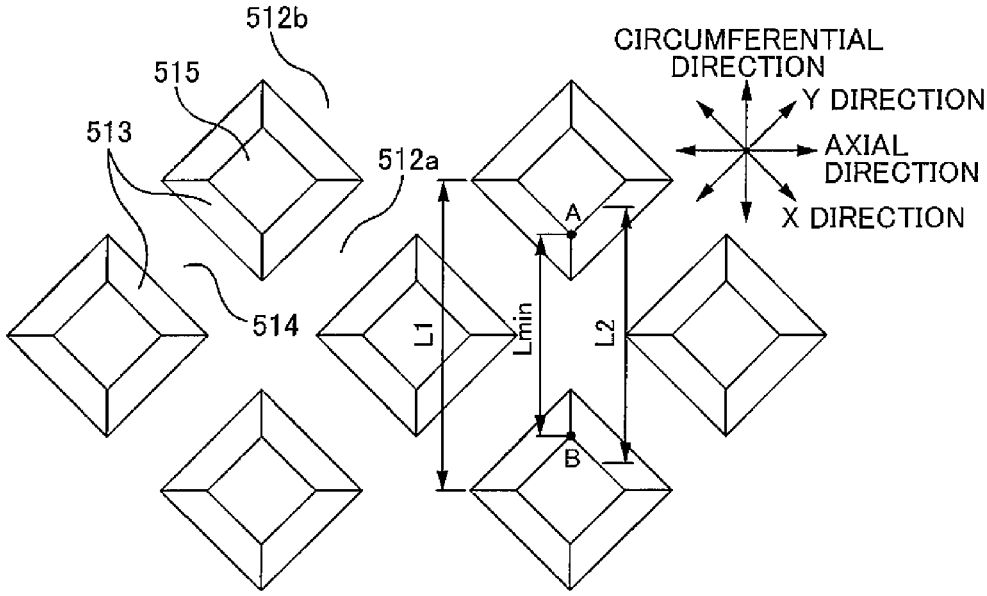
FIG. 9 is an enlarged schematic view of FIG. 7.
Figure 10:
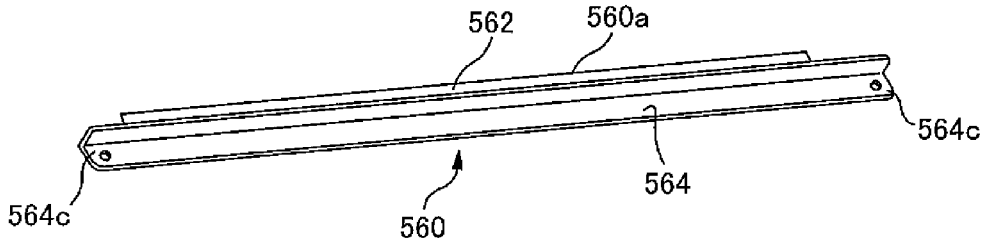
FIG. 10 is a perspective view of a regulating blade 560.
Figure 11:
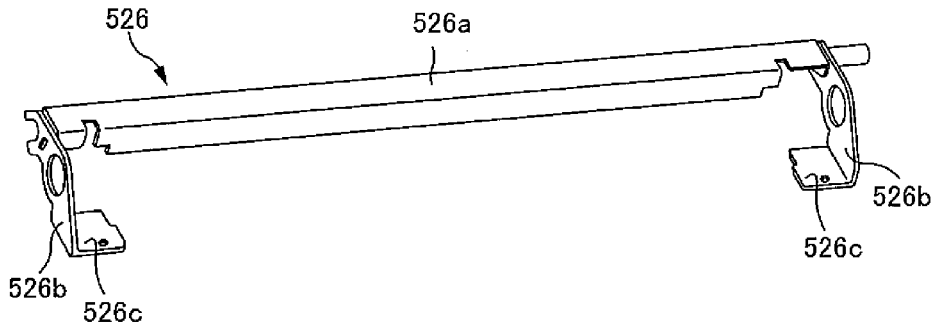
FIG. 11 is a perspective view of a holder 526.
Figure 12:
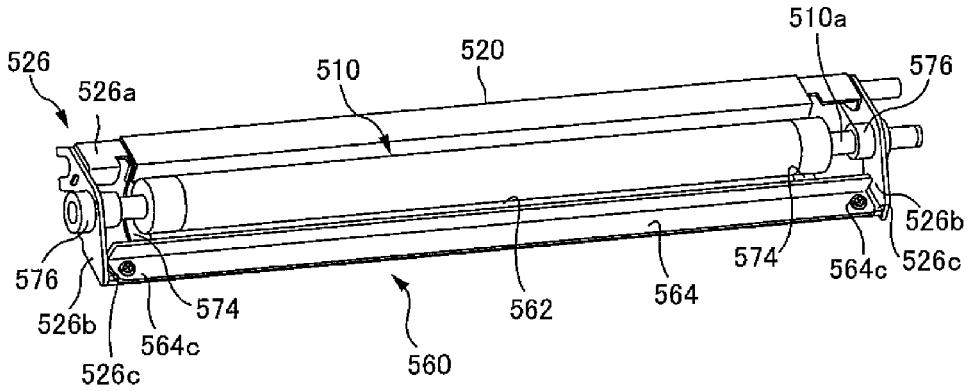
FIG. 12 is a perspective view illustrating the holder 526 to which an upper seal 520, the regulating blade 560 and the developing roller 510 are attached in an assembled manner.
Figure 13:
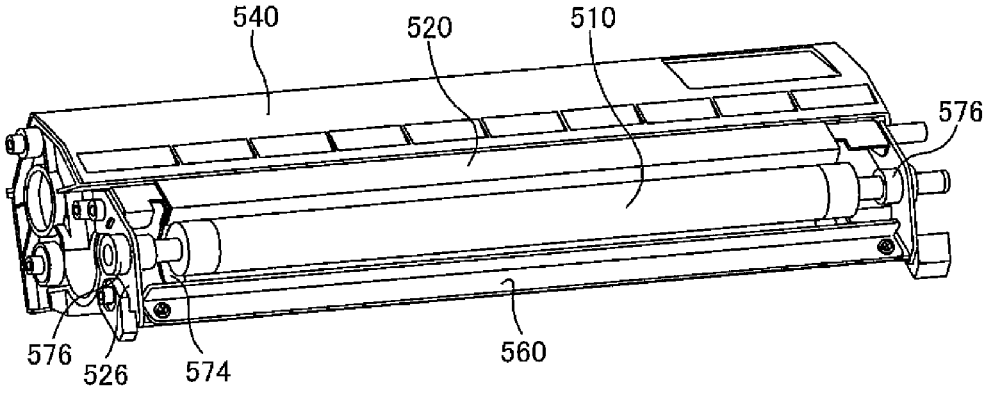
FIG. 13 is a perspective view illustrating the holder 526 attached to a housing 540.
Figure 14:
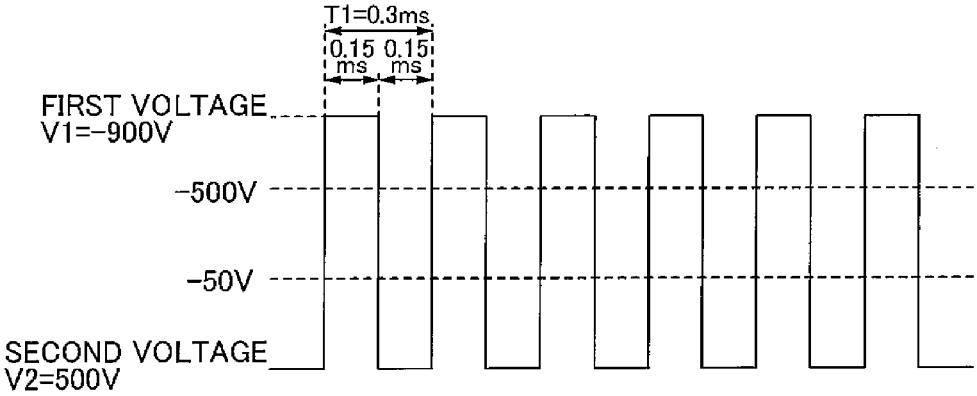
FIG. 14 is a schematic view showing a developing bias applied to the developing roller 510.

Next, the developing device is described with reference to FIGS. 4 through 14. FIG. 4 is a conceptual diagram of the developing device. FIG. 5 is a cross-sectional view showing the main structural components of the developing unit. FIG. 6 is a perspective schematic view of the developing roller 510. FIG. 7 is a front schematic view of the developing roller 510. FIG. 8 is a schematic view showing the cross section of a groove section 512. FIG. 9 is an enlarged schematic view of FIG. 7, and shows the groove section 512 and a top surface 515. FIG. 10 is a perspective view of a regulating blade 560. FIG. 11 is a perspective view of a holder 526. FIG. 12 is a perspective view illustrating the holder 526 to which an upper seal 520, the regulating blade 560 and the developing roller 510 are attached in an assembled manner. FIG. 13 is a perspective view illustrating the holder 526 attached to a housing 540. FIG. 14 is a schematic view showing a developing bias applied to the developing roller 510. It should be noted that the cross-sectional view shown in FIG. 5 shows the cross section obtained by cutting the developing device with a plane perpendicular to the longitudinal direction shown in FIG. 4. Further, in FIG. 5, the arrows indicate the vertical directions as in FIG. 1, and, for example, a central axis of the developing roller 510 is located below the central axis of the photoconductor 20. Also, in FIG. 5, the yellow developing device 54 is shown positioned at the developing position opposing the photoconductor 20. In FIGS. 6 to 9, the groove section 512 and the like are not to scale in order to make the figures simple.

The YMCK developing unit 50 is provided with the black developing device 51 containing a black (K) toner, the magenta developing device 52 containing a magenta (M) toner, the cyan developing device 53 containing a cyan (C) toner, and the yellow developing device 54 containing a yellow (Y) toner are provided. Since the configuration of the developing devices is the same, only the yellow developing device 54 will be explained below.

The yellow developing device 54 includes the developing roller 510, which is an example of a developer bearing member, the upper seal 520, a toner containing member 530, the housing 540, a toner supply roller 550, the regulating blade 560, the holder 526 or the like.

The developing roller 510 transports the toner T to the opposing position opposing the photoconductor 20 (developing position) by rotating with the toner T being borne thereon. The developing roller 510 is a member composed of aluminum alloy, iron alloy or the like.

The developing roller 510 includes the groove section 512, which is an example of a concave section, on the surface of a central portion 510*a* thereof in order to bear the toner T in an appropriate manner, as shown in FIGS. 6 and 7. In the present embodiment, two types of helical groove sections 512 having different helical directions from each other, namely, a first groove section 512*a* and a second groove section 512*b*, are provided as the groove section 512. As shown in FIG. 7, the inclination angles with respect to the circumferential direction of the developing roller 510 of the first groove section 512*a* and the second groove section 512*b* are mutually different, and the acute angle formed by the longitudinal direction of the first groove section 512*a* and the axis direction of the developing roller 510 and the acute angle formed by the longitudinal direction of the second groove section 512*b* and the axial direction are both approximately 45 degrees. As shown in FIG. 8, the width in X direction of the first groove section 512*a* and the width in Y direction of the second groove section 512*b* are approximately 50 μm, the depth of the groove section 512 is approximately 7 μm, and the groove angle (angle indicated with the symbol α in FIG. 8) is approximately 90 degrees.

As shown in FIGS. 6, 7 and 9, the two types of helical groove sections 512 thus configured are regularly disposed on the surface of the central portion 510*a* of the developing roller 510, and mutually intersect so as to form a grid pattern. Consequently, a large number of rhomboid-shaped top surfaces 515 surrounded by the groove sections 512 are formed in the central portion 510*a* on a grid pattern.

As described above, in the present embodiment, the acute angle formed by the longitudinal direction of the first groove section 512*a* and the axis direction, and the acute angle formed by the longitudinal direction of the second groove section 512*b* and the axial direction are both approximately 45 degrees. Therefore, the top surface 515 is a plane in a square shape. In addition, one (the other) of two diagonal lines of the top surface 515 is along the circumferential direction (axis direction) of the developing roller 510. It should be noted that the length of one side of the square top surface 515 is, as shown in FIG. 8, approximately 30 μm.

Further, the developing roller 510 is provided with a shaft section 510*b*. The developing roller 510 is rotatably supported as a result of the shaft section 510*b* being supported via a bearing 576 by a developing roller support section 526*b* of the holder 526 described later (FIG. 12). As shown in FIG. 5, the developing roller 510 rotates in a direction (counterclockwise in FIG. 5) opposite to the rotation direction of the photoconductor 20 (clockwise in FIG. 5). In the present embodiment, a moving velocity V of the surface of the developing roller 510 during rotation of the developing roller 510 (that is, the linear velocity of the developing roller 510 on the surface of the developing roller 510) is 300 mm/s. The moving velocity of the surface of the photoconductor 20 during rotation of the photoconductor 20 (that is, the linear velocity of the photoconductor 20 on the surface of the photoconductor 20) is 210 mm/s. Thus the circumferential velocity ratio of the developing roller 510 to the photoconductor 20 is approximately 1.4.

In a state in which the yellow developing device 54 opposes the photoconductor 20, there is a gap between the developing roller 510 and the photoconductor 20. That is, the yellow developing device 54 develops the latent image formed on the photoconductor 20 in a non-contacting state. Note that, the printer 10 of the present embodiment employs the jumping development method, and an alternating electric field is formed between the developing roller 510 and the photoconductor 20 when the latent image formed on the photoconductor 20 is developed (to be described in detail later).

The housing 540 is manufactured by welding together a plurality of integrally-molded resin housing sections, that is, an upper housing section 542 and a lower housing section 544. A toner containing member 530 for containing the toner T is formed inside the housing 540. The toner containing member 530 is divided by a partitioning wall 545 for partitioning the toner T, which protrudes inwards (in the vertical direction of FIG. 5) from the inner wall, into two toner containing sections, namely, a first toner containing section 530*a* and a second toner containing section 530*b*. The first toner containing section 530*a* and the second toner containing section 530*b* are in communication at the top portion, and in the state shown in FIG. 5, the moving of the toner T is regulated by the partitioning wall 545. However, when the YMCK developing unit 50 rotates, the toner contained in the first toner containing section 530*a* and the second toner containing section 530*b* is temporarily collected on the side where the top portion sides are in communication in the developing position, and when it returns to the state shown in FIG. 5, the toner is mixed and returned to the first toner containing section 530*a* and the second toner containing section 530*b*. That is to say, through rotation of the YMCK developing unit 50, the toner T in the developing device is suitably stirred.

For this reason, in the present embodiment, the toner containing member 530 is not provided with a stirring member, but it is also possible to provide a stirring member for stirring the toner T contained in the toner containing member 530. Moreover, as shown in FIG. 5, the housing 540 (that is, the first toner containing section 530*a*) has an aperture 572 at its lower portion, and the developing roller 510 is arranged such that it faces this aperture 572.

The toner supply roller 550 is provided in the first toner containing section 530*a* described above and supplies the toner T contained in the first toner containing section 530*a* to the developing roller 510. The toner supply roller 550 scrapes off the toner T remaining on the developing roller 510 after developing from the developing roller 510. The toner supply roller 550 is made of polyurethane foam, for example, and is in contact with the developing roller 510 in a state of elastic deformation. The toner supply roller 550 is disposed at a lower portion of the first toner containing section 530*a*, and the toner T contained in the first toner containing section 530*a* is supplied to the developing roller 510 by the toner supply roller 550 at the lower portion of the first toner containing section 530*a*. The toner supply roller 550 is rotatable about its central axis. A central axis of the toner supply roller 550 is located below the central axis of rotation of the developing roller 510. Also, the toner supply roller 550 rotates in a direction (clockwise in FIG. 5) opposite to the rotation direction of the developing roller 510 (counterclockwise in FIG. 5).

The upper seal 520 contacts against the developing roller 510 along the axial direction thereof. It allows moving of the toner T remaining on the developing roller 510 to the inside of the housing 540 after passing the developing position, and also regulates moving of the toner T inside the housing 540 to the outside of the housing 540. The upper seal 520 is a seal made of polyethylene film and the like. The upper seal 520 is supported by an upper seal support section 526*a* of the holder 526 described later, and disposed with its longitudinal direction along with the axial direction of the developing roller 510 (FIG. 12). It should be noted that the contact position where the upper seal 520 contacts against the developing roller 510 is above the central axis of the developing roller 510.

Between a plane of the upper seal 520 on the opposite side to a contacting plane 520*b* that contacts against the developing roller 510 (such plane is referred to as an "opposite plane 520*c*") and the upper seal support section 526*a*, an upper seal biasing member 524 composed of an elastic material such as Moltopren is provided in an compressed state. The upper seal biasing member 524 biases the upper seal 520 toward the developing roller 510 with its biasing force so as to press the upper seal 520 against the developing roller 510.

The regulating blade 560 contacts against the developing roller 510 at a contacting section 562*a* through one end portion to the other end portion in the axial direction of the developing roller 510, so as to regulate the layer thickness of the toner T borne on the developing roller 510 and charge the toner T borne on the developing roller 510. The regulating blade 560 includes, as shown in FIGS. 5 and 10, a rubber section 562 and a rubber support section 564.

The rubber section 562 is made of silicon rubber, urethane rubber or the like, and contacts against the developing roller 510.

The rubber support section 564 is constituted by a thin plate 564*a* and a thin plate support section 564*b*. The rubber support section 564 supports a rubber section 562 at a transverse direction one end portion 564*d* (namely, an end portion on the side of the thin plate 564*a*). The thin plate 564*a* is made of phosphor bronze, stainless steel or the like, and has spring property. The thin plate 564*a* supports the rubber section 562, and uses its biasing force to press the rubber section 562 against the developing roller 510. The thin plate support section 564*b* is a sheet metal disposed at the transverse direction other end portion 564*e* of the rubber support section 564. The thin plate support section 564*b* is attached to the thin plate 564*a* while supporting the thin plate 564*a* at the end portion thereof, which is on the opposite side to the side where the thin plate 564*a* supports the rubber section 562.

The regulating blade 560 is attached to a regulating blade support section 526*c* with longitudinal direction end portions 564*c* of the thin plate support section 564*b* being supported by the regulating blade support section 526*c* of the holder 526 described later.

The end of the regulating blade 560 that is on the opposite side to the thin plate support section 564*b*, that is, a distal end 560*a* is not in contact with the developing roller 510, and a portion that is distant from the distal end 560*a* by a predetermined distance (namely, the contacting section 562*a*) contacts the developing roller 510 at an area having a certain width. Specifically, the regulating blade 560 does not contact against the developing roller 510 at the edge, but at an area having a certain width. Accordingly, that area of a plane of the regulating blade 560 contacts against the developing roller 510 so as to regulate the layer thickness. Also, the regulating blade 560 is disposed such that its distal end 560*a* faces upstream in the direction in which the developing roller 510 rotates, and it is in so-called counter contact. It should be noted that the contact position where the regulating blade 560 contacts against the developing roller 510 is lower than the position of the central axis of the developing roller 510 and is lower than the central axis of the toner supply roller 550. Also, the regulating blade 560 performs a function to prevent leakage of the toner T from the toner containing member 530 by contacting against the developing roller 510 along the axial direction thereof.

Also as shown in FIG. 12, on the outer end portion in the longitudinal direction of the rubber section 562 of the regulating blade 560, an end portion seal 574 is provided. The end portion seal 574 is made up of a nonwoven fabric, and contacts the developing roller 510 at the end portion in the axial direction thereof along the circumferential surface of the developing roller 510, so as to perform a function to prevent leakage of the toner T from a space between the circumferential surface and the housing 540.

The holder 526 is a metal member on which various members such as the developing roller 510 are assembled. As shown in FIG. 11, it includes the upper seal support section 526*a* disposed along the longitudinal direction of the holder 526 (namely, the axial direction of the developing roller 510), the developing roller support section 526*b* that is provided on the outside in the longitudinal direction (the axial direction) of the upper seal support section 526*a* and intersects the longitudinal direction (the axial direction), and the regulating blade support section 526*c* that intersects the developing roller support section 526*b* and faces the end portion in the longitudinal direction of the upper seal support section 526*a*.

As shown in FIG. 12, the upper seal 520 is supported by the upper seal support section 526*a* at the transverse direction end portion 520*a* thereof (FIG. 5), and the developing roller 510 is supported by the developing roller support section 526*b* at its ends.

Further, the regulating blade 560 is supported by the regulating blade support sections 526*c* at the longitudinal direction end portions 564*c* of the regulating blade 560. The regulating blade 560 is fixed to the regulating blade support section 526*c* with screws so as to be fixed to the holder 526.

In this manner, the holder 526 on which the upper seal 520, the developing roller 510 and the regulating blade 560 are attached in an assembled manner, is attached to the above-described housing 540 via a housing seal 546 (FIG. 5) for preventing leakage of the toner T from a space between the holder 526 and the housing 540, as shown in FIG. 13.

In the yellow developing device 54 configured as described above, the toner supply roller 550 supplies the toner T contained in the toner containing member 530 to the developing roller 510. The toner T that is supplied to the developing roller 510 is brought to the contact position of the regulating blade 560 with the rotation of the developing roller 510, and when it passes the contact position, the layer thickness of the toner T is regulated, and negative charge is added (charged to the negative polarity). The toner T on the developing roller 510 charged to the negative polarity, whose layer thickness has been regulated, is transported to the opposing position in opposition to the photoconductor 20 (developing position) due to further rotation of the developing roller 510, and is supplied for developing the latent image formed on the photoconductor 20 at the opposing position.

Here, development of the latent image is described with reference to FIG. 14. As described above, the printer 10 of the present embodiment employs the jumping development method. When the jumping developing is carried out, the alternating voltage applying section 132 applies a square alternating voltage to the developing roller 510. The alternating voltage includes a first voltage V1 and a second voltage V2, as shown in FIG. 14.

The first voltage V1 is voltage for moving toner from the developing roller 510 to the photoconductor 20, and its value is −900 V. In the present embodiment, as shown in FIG. 14, during development, the potential of the photoconductor 20 is −500 V for a non-image area (a portion corresponding to white image) and −50 V for an image area (a portion corresponding to black image), and moreover, the toner is charged to negative polarity. Therefore, when the first voltage V1 is applied to the developing roller 510, an electrical field that moves toner from the developing roller 510 to the photoconductor 20 is formed between the developing roller 510 and the photoconductor 20. As a result, the toner on the developing roller 510 moves toward the photoconductor 20.

On the other hand, the second voltage V2 is voltage for moving toner from the photoconductor 20 to the developing roller 510, and its value is 500 V. When the second voltage V2 is applied to the developing roller 510, an electrical field that moves toner from the photoconductor 20 to the developing roller 510 is formed between the developing roller 510 and the photoconductor 20. As a result, the toner on the photoconductor 20 moves toward (is drawn back to) the developing roller 510.

As shown in FIG. 14, since the first voltage V1 and the second voltage V2 are applied alternately by the alternating voltage applying section 132, during development of latent images, the toner alternately repeats moving from the developing roller 510 to the photoconductor 20, and moving (returning) from the photoconductor 20 to the developing roller 510.

In the present embodiment, the period during which the alternating voltage applying section 132 continuously applies the first voltage V1 and the period during which the alternating voltage applying section 132 continuously applies the second voltage V2 are both 0.15 ms (milliseconds)(namely, duty ratio is 50%). Accordingly, the cycle period of alternating voltage (this cycle period is referred to as a "cycle T1") is 0.3 ms (milliseconds) (see FIG. 14). Also, the average voltage that the alternating voltage applying section 132 applies to the developing roller 510 is higher than the potential for the non-image area (−500 V) and lower than the potential for the image area (−50 V), which is −200 V (=(−900+500)/2).

The toner T on the developing roller 510 that has passed the developing position due to rotation of the developing roller 510 passes the upper seal 520 and is collected in the developing device without being scraped off by the upper seal 520. Moreover, the toner T that is still remaining on the developing roller 510 is scraped off by the toner supply roller 550.

Discharge Phenomenon

As already described, the printer 10 of the present embodiment is provided with the alternating voltage applying section 132 for applying to the developing roller 510 an alternating voltage (developing bias) including a first voltage V1 for moving toner from the developing roller 510 to the photoconductor 20, and a second voltage V2 for moving toner from the photoconductor 20 to the developing roller 510 during development of the latent image using the toner. In addition, the groove section 512 is provided on the surface of the developing roller 510 as an example of the regularly disposed concave section. As described above, in such a printer 10, the discharge phenomenon may occur between the photoconductor 20 and the developing roller 510 during development of the latent images, which causes defective images.

In this section, conditions in which the discharge phenomenon may occur are described first. Then, in the printer 10 of the present embodiment, occurrence of the discharge phenomenon is less likely than in conventional printers, and this point (namely, effectiveness of the printer 10 of the present embodiment) is described in details Conditions in which the Discharge Phenomenon May Occur It is known that the discharge phenomenon is likely to occur under the conditions described below.

(1) When the Voltage of the Alternating Voltage is Switched

When the voltage of the alternating voltage (developing bias) is switched, the discharge phenomenon is likely to occur. While there are two possible cases for such switching of the developing bias, that is, switching from a negative voltage to a positive voltage, and switching from a positive voltage to a negative voltage, the discharge phenomenon is likely to occur in the former case. In the printer 10 of the present embodiment, the discharge phenomenon is likely to occur when the developing bias is switched from the first voltage V1 (−900V) to the second voltage V2 (+500V).

(2) When a Boundary Between the Grove Section 512 and the Top Surface 515 (Concave Section and Non-Concave Section) is at an Opposing Position Opposing the Photoconductor 20

Since the developing roller 510 is provided with the regularly disposed groove sections 512, when the developing roller 510 rotates while developing latent images, the groove section 512 reaches the opposing position opposing the photoconductor 20 and the top surface 515 reaches the opposing position (repeats alternately reaching). When the boundary between the groove section 512 and the top section 515 (for example, the portions shown by the symbols A and B in FIG. 9) reaches the opposing position, the discharge phenomenon is likely to occur.

In some cases, the above-described conditions (1) and (2) occur concurrently during development of latent images. An example of such cases is a case in which the developing bias is switched from the first voltage V1 (−900 V) to the second voltage V2 (+500 V) when the boundary between the groove section 512 and the top surface 515 has reached the opposing position. In such a case, occurrence of the discharge phenomenon is highly likely.

Effectiveness of the Printer 10 of the Present Embodiment

In the printer 10 of the present embodiment, the above-described the cycle period (cycle T1) of the developing bias is larger than a value obtained by dividing a minimum width Lmin of the groove section 512 in the circumferential direction of the developing roller 510 by the moving velocity v of the surface of the developing roller 510 during rotation of the developing roller 510 (T1>Lmin/V). Accordingly, with the printer 10 of the present embodiment in which the width of the groove section 512 and the cycle period of the developing bias satisfy the above-described condition, it is possible to appropriately suppress occurrence of the discharge phenomenon.

This is described in detail below with reference to FIGS. 9 to 15. As described above, the two types of helical groove sections 512 having different inclination angles with respect to the circumferential direction are provided on the surface of the developing roller 510 of the present embodiment, and these two types of helical groove sections 512 mutually intersect so as to form a grid pattern. Also, the developing roller 510 has the square-shaped top surface 515 surrounded by the two types of helical groove sections 512, and one of two lines of the square-shaped top surface is along the circumferential direction of the developing roller 510 (FIG. 9). In the developing roller 510 (as shown in FIG. 9), while the width of the groove section 512 in the circumferential direction of the developing roller 510 may be defined in various manners, such as a width L1, width L2, the minimum width is the width Lmin shown in FIG. 9 (a distance between the points A and B in FIG. 9). It should be noted that the value of the width Lmin is approximately 70.71 μm.

In addition, as described above, the moving velocity V of the surface of the developing roller 510 during rotation of the developing roller 510 is 300 mm/s. Therefore, the value Lmin/V, which is obtained by dividing the minimum width Lmin by the moving velocity V of the surface of the developing roller 510 during rotation of the developing roller 510 is approximately 0.236 ms (milliseconds). As shown in FIG. 14, since the cycle period of the developing bias (cycle T1) is 0.3 ms, the condition of T1>Lmin/V is satisfied in the present embodiment.

Next, the reason why occurrence of the discharge phenomenon can be appropriately suppressed when the condition of T1>Lmin/V is satisfied is described with reference to FIG. 15.

In the case in which the developing bias is switched from the first voltage V1 (−900 V) to the second voltage V2 (+500 V) when the boundary between the groove section 512 and the top surface 515 (for example, the portions indicated by the symbols A and B in FIG. 9) has reached the opposing position (in other words, when the above-described conditions (1) and (2) occur concurrently), occurrence of the discharge phenomenon is highly likely, and this is described in the above section "Conditions in which the Discharge Phenomenon May Occur". Actually, such a condition does not necessarily cause the discharge phenomenon, and the discharge phenomenon may not occur even in that condition. However, even if occurrence of the discharge phenomenon could be avoided in that condition during development of latent images, if a similar condition occurs in a short time (without a long interval), it is highly likely that the discharge phenomenon occurs at that time.

Figure 15:
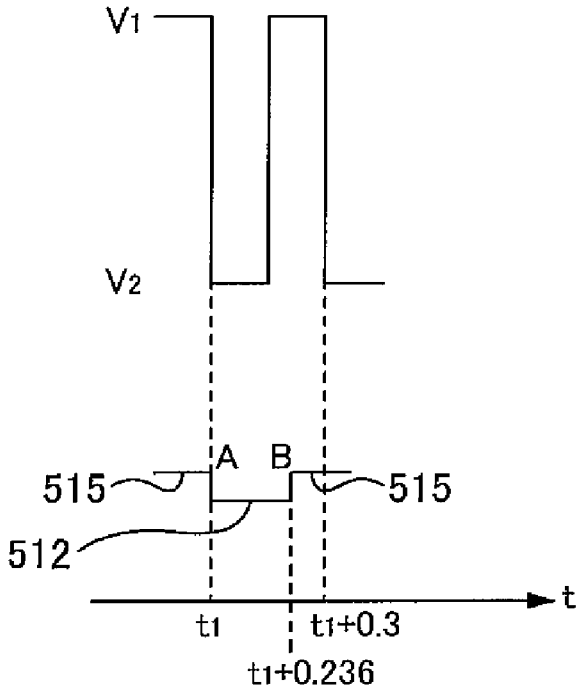
FIG. 15 is an explanatory diagram for describing superiority of the printer 10 of the present embodiment.

Now, FIG. 15 is referred to. FIG. 15 is an explanatory diagram for describing effectiveness of the printer 10 of the present embodiment, and shows, from the top, two figures (these are respectively referred to as an "upper figure" and a "lower figure") and the time axis.

Here, the lower figure in FIG. 15 shows which portion of the developing roller 510 is located at the opposing position opposing the photoconductor 20 at a certain time t while the latent image is being developed. For example, during development of the latent image, when the portion indicated with the symbol A in FIG. 9 is positioned at the opposing position at a time t1, approximately 0.236 ms (=Lmin/v) after the time t1, the portion indicated with the symbol B in FIG. 9 will be positioned at the opposing position due to rotation of the developing roller 510. Since Lmin represents the minimum width, the lower figure shows that once the above-described condition (1) occurred, the condition (1) is to occur again in 0.236 ms at the earliest.

On the other hand, since the cycle period (0.3 ms) of the developing bias is larger than Lmin/V (0.236 ms), for example, even if the above-described condition (1) and switching of the developing bias from the first voltage 1 (−900 V) to the second voltage (+500V) (namely, the above-described condition (2)) occur concurrently at a time t1 during development of latent images (see the upper and lower figures in FIG. 15), it is made sure that next time the condition (1)

occurs at the earliest (in 0.236 ms), the condition (2) does not occur. In this manner, in the printer 10 of the present embodiment, conditions in which occurrence of the discharge phenomenon is highly likely (that is, concurrent occurrence of the above-described conditions (1) and (2)) do not occur successively in a short time, and therefore occurrence of the discharge phenomenon is appropriately suppressed.

Uneven Density Due to the Developing Bias and the Charging Bias

As described above, an alternating voltage (developing bias) including the first voltage V1 and the second voltage V2 is applied to the developing roller 510. It is known that uneven density occurs in images due to this developing bias. This uneven density is likely to occur every cycle period of the developing bias (cycle T1). Similarly, a superimposed voltage (charging bias) in which DC voltage and AC voltage are superimposed is applied to the charging roller 31. It is known that uneven density occurs in images due to the AC voltage component of the charging bias. Furthermore, the uneven density is likely to occur every cycle period of the charging bias (cycle T2). When these two types of uneven density occur, and these two types of uneven density occur at the same location, the uneven density becomes conspicuous, and consequently the uneven density in images becomes highly noticeable.

Figure 16A:
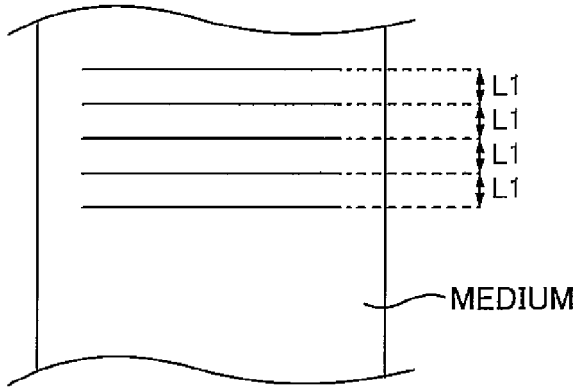
FIG. 16A is a schematic view illustrating uneven density due to the developing bias.
Figure 16B:
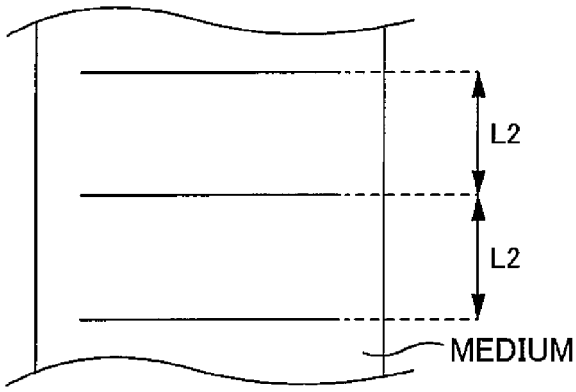
FIG. 16B is a schematic view illustrating uneven density due to the charging bias.
Figure 16C:
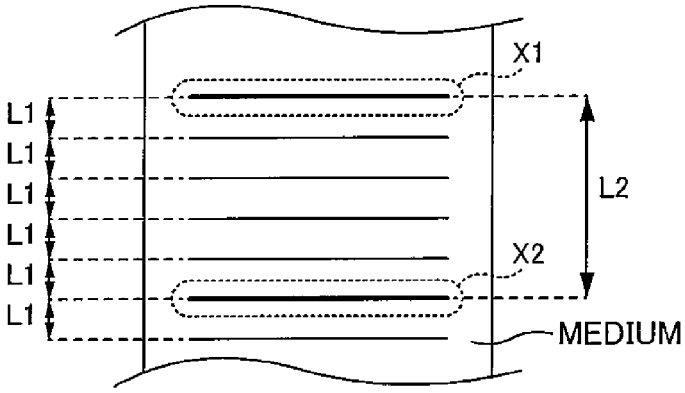
FIG. 16C is a schematic view illustrating a state in which the degree of uneven density has been strengthened.

This phenomenon is described specifically with reference to the comparative examples shown in FIGS. 16A to 16C. FIG. 16A is a schematic view illustrating uneven density due to the developing bias. FIG. 16B is a schematic view illustrating uneven density due to the charging bias. FIG. 16C is a schematic view illustrating a state in which the degree of uneven density has been strengthened.

The uneven density due to developing bias occurs every predetermined interval L1, as shown in FIG. 16A. This predetermined interval L1 is a value obtained by multiplying the moving velocity of the photoconductor 20 by the cycle T1 of the developing bias. Similarly, the uneven density due to charging bias occurs every predetermined interval L2, as shown in FIG. 16B. This predetermined interval L2 is a value obtained by multiplying the moving velocity of the photoconductor 20 by the cycle T2 of the charging bias. These two types of uneven density occur independently.

In addition, when an image is formed, the initial occurrence position of the uneven density due to developing bias and the initial occurrence position of the uneven density due to charging bias may coincide (the region X1 surrounded by the dotted line in FIG. 16C). When the occurrence positions of the two types of uneven density coincide, the uneven density becomes conspicuous. In such a case, for example, when the cycle T1 of the developing bias is the same as a value obtained by dividing the cycle T2 of the charging bias by any positive integer, it is probable that subsequent occurrence positions of the uneven density due to the charging bias and occurrence positions of the uneven density due to the developing bias coincide in succession (the region X2 surrounded by the dotted line in FIG. 16C). Therefore, the uneven density becomes further conspicuous every predetermined interval L2, and consequently the uneven density becomes highly noticeable.

On the other hand, in the printer 10 of the present embodiment, as shown in FIGS. 3B and 14, the above-described cycle T1 (0.2 ms) of the developing bias is neither a value obtained by multiplying the cycle T2 (0.9 ms) of the charging bias by any positive integer, nor a value obtained by dividing the cycle T2 by any positive integer. That is, the condition of $T1 \neq nT2$ is true for T1 and T2 (where n is a positive integer or a reciprocal of positive integer). Although in such a case as well the occurrence position of the uneven density due to developing bias and the occurrence position of the uneven density due to charging bias may coincide, even if the occurrence positions of the two types of uneven density coincide, unlike the above-described case of a comparative example, it is possible to prevent successive coincidence of subsequent occurrence positions of the uneven density due to developing bias and occurrence positions of the uneven density due to charging bias. Consequently, it is possible to prevent the uneven density in images from becoming conspicuous.

In this manner, in the printer 10 of the present embodiment in which the cycle T1 of the developing bias and the cycle T2 of the charging bias satisfy the above-described condition, it is possible to suppress the uneven density in images from becoming conspicuous.

Control to Change the Cycle Periods of the Developing Bias and the Charging Bias As described above, the printer 10 can form images on media. Examples of types of media include special paper such as thick paper or an OHP transparency, and plain paper. The printer 10 changes the processing speed of the printer (for example, the moving velocity of the surface of the photoconductor 20, or the moving velocity V of the surface of the developing roller 510) depending on the type of a medium, such that images are appropriately formed depending on the type of the medium. Specifically, the printer 10 increases the processing speed when forming images on plain paper, and decreases the processing speed when forming images on special paper.

The printer 10 of the present embodiment performs control for changing the cycle period of the developing bias and the cycle period of the charging bias when the processing speed of the printer is changed depending on the type of the medium (as a result, the moving velocity V of the surface of the developing roller 510 is also changed), so as to appropriately suppress occurrence of the discharge phenomenon and suppress conspicuous uneven density in images. Specifically, the control unit 100 (1) changes the cycle period of the developing bias (hereinafter referred to as the "cycle T1") such that the changed cycle T1 is larger than a value obtained by dividing the minimum width Lmin of the groove section 512 in the circumferential direction of the developing roller 510 by the moving velocity V changed accordingly, and (2) changes the cycle period of the charging bias (hereinafter referred to as the "cycle T2") such that the changed cycle T1 of the developing bias is neither a value obtained by multiplying the changed cycle T2 by any positive integer, nor a value obtained by dividing the changed cycle T2 by any positive integer.

Figure 17:
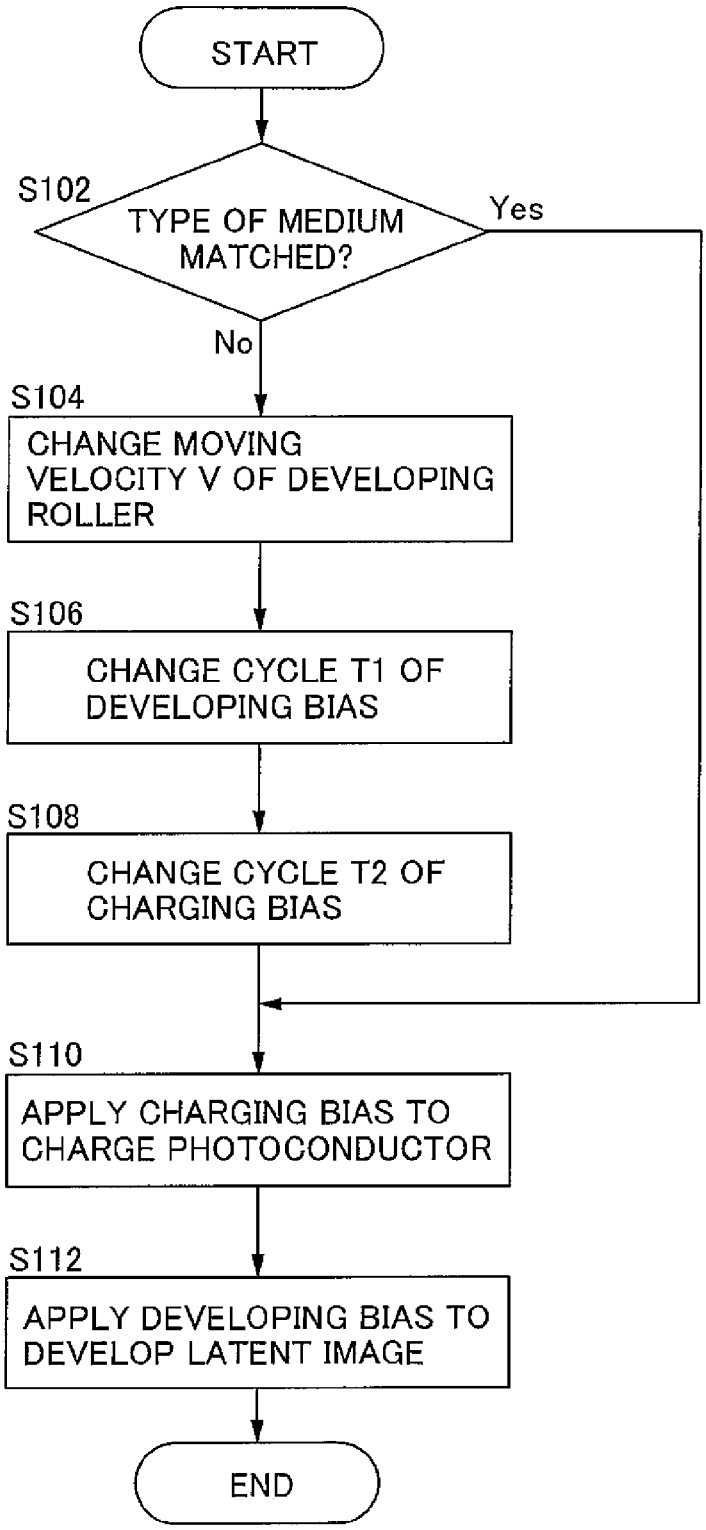
FIG. 17 is a flowchart for describing control operations of the printer 10 according to the invention.

In the following, an operational example for the above-described control of the printer 10 is explained with reference to FIG. 17. FIG. 17 is a flowchart for describing operations for the above-described control of the printer 10.

Various operations performed to execute the above-described operations of the printer 10 are mainly realized by the control unit 100. In particular, in the present embodiment, the operations are realized by the CPU executing programs stored in a ROM. These programs are constituted by program code for performing various operations described below.

This control is executed when the printer 10 receives an image signal and a control signal from a computer, which is an external apparatus. This control signal contains information on the type of a medium selected by the user or the like (specifically, one of "plain paper", "thick paper" and "OHP transparency").

First, the control unit 100 determines whether the type of the medium indicated by the control signal matches the predetermined type of medium (in this case, the predetermined medium type is assumed to be "plain paper") (Step S102).

In this example, the type of the medium included in the control signal is assumed to be "thick paper". In such a case, since the type of the medium included in the control signal ("thick paper") does not match the predetermined type of medium ("plain paper") ("No" in step S102), the control unit 100 changes the processing speed (moving velocity V of the developing roller 510) (step S104).

FIG. 18 is a table showing the relationship between the type of media and the moving velocity V of the developing roller 510 and the like, which is stored in ROM or the like of the control unit 100. As can be understood from the table, the moving velocity V of the developing roller 510 when forming images on "plain paper" is 300 mm/s, the moving velocity V of the developing roller 510 when forming images on "thick paper" is 225 mm/s, and the moving velocity V of the developing roller 510 when forming images on "OHP transparency" is 150 mm/s.

In this example, since images are formed on "thick paper", the control unit 100 changes the moving velocity V of the developing roller 510 from 300 mm/s to 225 mm/s.

When the moving velocity V of the developing roller 510 is changed, the control unit 100 changes the cycle T1 of the developing bias and the cycle T2 of the charging bias (steps S106 and S108).

In the table shown in FIG. 18, the relationship of the type of media with the cycle T1 of the developing bias and the cycle T2 of the charging bias is shown. For example, when the moving velocity V of the developing roller 510 is 225 mm/s, the cycle T1 of the developing bias is 0.3 ms, and the cycle T2 of the charging bias is 1.0 ms. As can be understood from the table, as the moving velocity V of the developing roller 510 decreases, the cycle T1 of the developing bias and the cycle T2 of the charging bias increase.

In this example, the moving velocity V of the developing roller 510 is changed from 300 mm/s to 225 mm/s. Accordingly, due to change in the moving velocity V of the developing roller 510, the control unit 100 changes the cycle T1 of the developing bias from 0.3 ms to 0.4 ms, and changes the cycle T2 of the charging bias from 1.0 ms to 1.1 ms.

Incidentally, as described above, when the moving velocity V of the developing roller 510 is 300 mm/s, the cycle T1 (0.3 ms) of the developing bias and the cycle T2 (1.0 ms) of the charging bias satisfy two expressions (that is, T1>Lmin/V, and T1≠nT2). The cycle T1 of the developing bias and the cycle T2 of the charging bias are set such that these two expressions are true for both cases in which the moving velocity V of the developing roller 510 is 225 mm/s and the moving velocity is 150 mm/s. For this reason, even though the moving velocity V of the developing roller 510 is changed depending on the type of media (for example, is changed from 300 mm/s to 225 mm/s), these cycle periods are changed to the cycle T1 (0.4 ms) of the developing bias and the cycle T2 (1.1 ms) of the charging bias so as to satisfy the above two expressions (that is, T1>Lmin/V, and T1≠nT2). Therefore, it is possible to appropriately suppress occurrence of the discharge phenomenon and suppress conspicuous uneven density in images.

Returning to the flowchart in FIG. 17, description of operations of the printer 10 for the above-described control is continued.

The control unit 100 applies a charging bias to the charging roller 31 to charge the photoconductor 20 (step S110). In this example, the superimposed voltage applying section 133 applies a charging bias whose cycle T2 was changed to 1.1 ms in step S108 to the rotating charging roller 31, so as to charge the photoconductor 20.

Next, the control unit 100 applies a developing bias to the developing roller 510 to develop a latent image on the photoconductor 20 (step S112). In this example, the alternating voltage applying section 132 applies a developing bias whose cycle T1 was changed to 0.4 ms in step S106 to the rotating developing roller 510, so as to develop the latent image.

In the above description, although the control unit 100 changed the moving velocity V of the developing roller 510, when the type of the medium indicated by the control signal matches the predetermined type of medium ("plain paper") ("Yes" in step S102), the control unit 100 does not change the moving velocity V of the developing roller 510. In such a case, the control unit 100 does not change the cycle T1 of the developing bias or the cycle T2 of the charging bias. In other words, the moving velocity V of the developing roller 510 is 300 mm/s, and the cycle T1 of the developing bias is 0.3 ms and the cycle T2 of the charging bias is 1.0 ms. Then, the charging roller 31 is charged by the superimposed voltage applying section 133 applying a charging bias whose cycle T2 is 1.0 ms (step S110), and the latent image is developed by the alternating voltage applying section 132 applying a developing bias whose cycle T1 is 0.3 ms (step S112).

At this time as well, the above two expressions (that is, T1>Lmin/V, and T1≠nT2) are satisfied, and therefore it is possible to appropriately suppress occurrence of the discharge phenomenon and suppress conspicuous uneven density in images.

Method for Manufacturing the Developing Device

Figure 20:
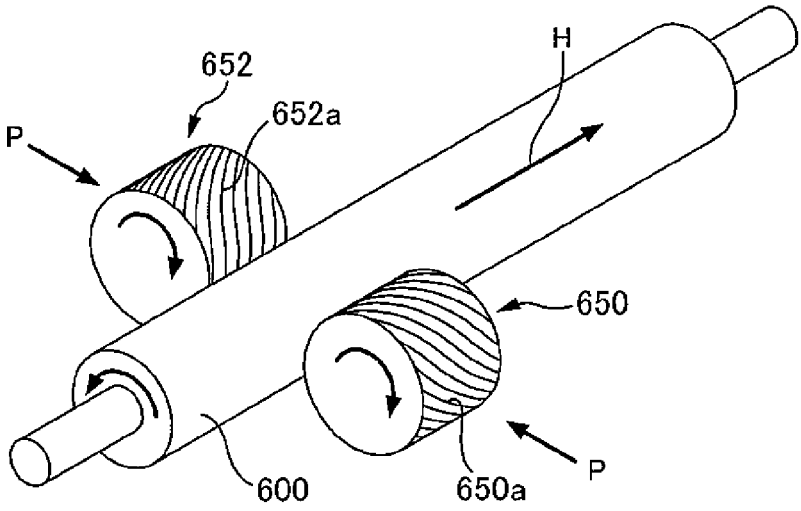
FIG. 20 is an explanatory diagram for describing a rolling process of the developing roller 510.
Figure 21:
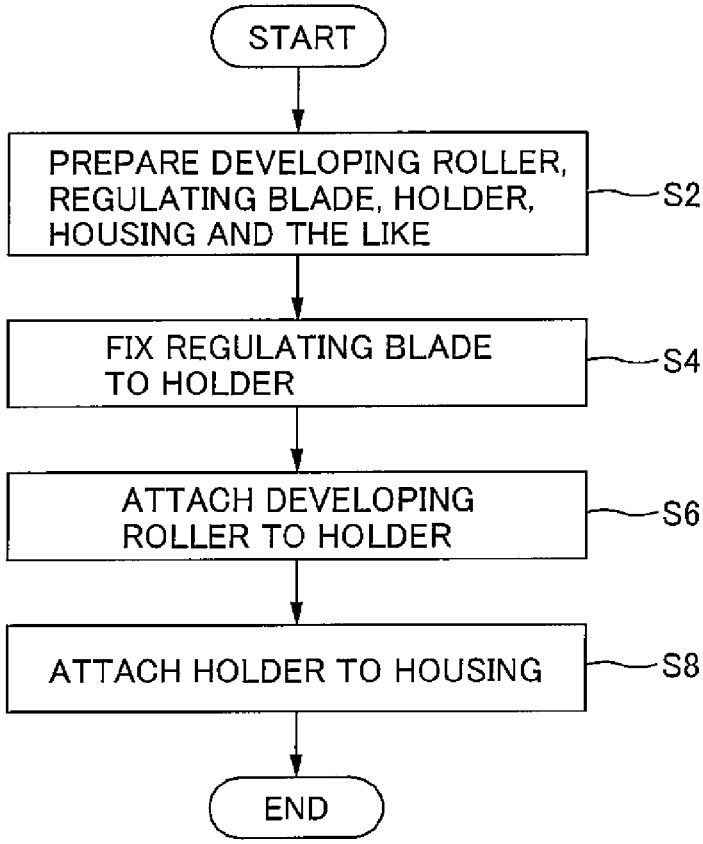
FIG. 21 is a flowchart for describing an assembly method for a yellow developing device 54.

Here, the method for manufacturing the developing device is described with reference to FIGS. 19A to 21. FIGS. 19A to 19E are schematic views showing transitional states of the developing roller 510 during the manufacturing process of the developing roller 510. FIG. 20 is an explanatory diagram for describing a rolling process of the developing roller 510. FIG. 21 is a flowchart for describing an assembly method of the yellow developing device 54. It should be noted that in manufacturing the developing device, the above-described housing 540, holder 526, developing roller 510, toner supply roller 550, regulating blade 560 and the like are manufactured first. Then, the developing device is manufactured by assembling these members. Now, among manufacturing methods for these members, the method for manufacturing the developing roller 510 is described first, and thereafter the method for assembling the developing device is described. In the following description, of the black developing device 51, magenta developing device 52, cyan developing device 53 and yellow developing device 54, the yellow developing device 54 is taken as an example.

Method for Manufacturing the Developing Roller 510

The method for manufacturing the developing roller 510 is described with reference to FIGS. 19A to 20.

Figure 19A:
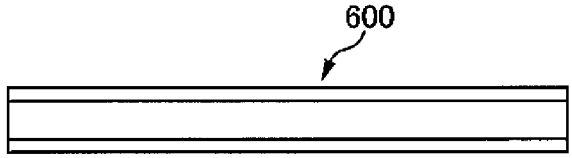
FIG. 19B is a schematic view showing a transitional state (2) of the developing roller 510 during the manufacturing process of the developing roller 510.
FIG. 19C is a schematic view showing a transitional state (3) of the developing roller 510 during the manufacturing process of the developing roller 510.
FIG. 19D is a schematic view showing a transitional state (4) of the developing roller 510 during the manufacturing process of the developing roller 510.
FIG. 19E is a schematic view showing a transitional state (5) of the developing roller 510 during the manufacturing process of the developing roller 510.
Figure 19B:
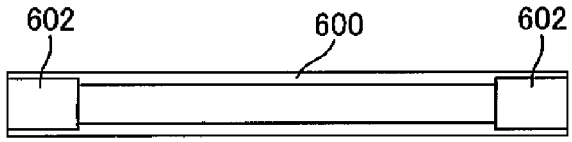
Figure 19C:
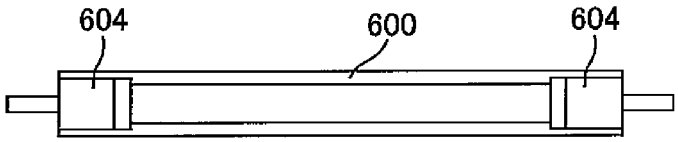
Figure 19D:
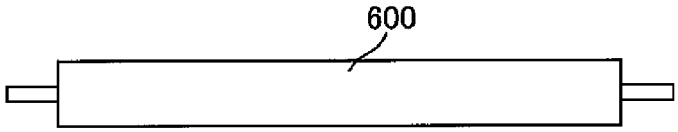
Figure 19E:
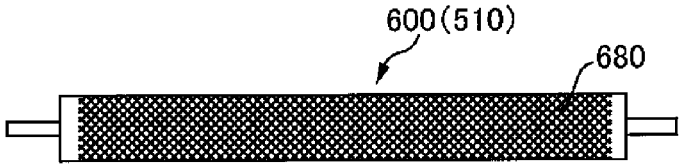

First of all, as shown in FIG. 19A, a pipe member 600 is prepared, which is used as the base material of the developing roller 510. The pipe member 600 has a wall thickness of 0.5 to 3 mm. Then, as shown in FIG. 19B, a flange press-fit section 602 is formed at the both ends in the longitudinal direction of the pipe member 600. The flange press-fit section 602 is formed by a cutting process. Next, as shown in FIG. 19C, a flange 604 is press-fitted to the flange press-fit section 602. In order to securely fix the flange 604 to the pipe member 600, the flange 604 may be bonded or welded to the pipe member 600 after being press fitted to the pipe member 600. Next, as shown in FIG. 19D, the surface of the pipe member 600 to which the flange 604 is press-fitted is subjected to centerless grinding. This centerless grinding is performed over the entire surface, such that the ten-point average roughness Rz on the surface after the centerless grinding is equal to or less than 1.0 μm. As shown in FIG. 19E, the pipe member 600 with the flange 604 press-fitted thereto is subjected to a rolling process. In the present embodiment, so-called through feed rolling (also called continuous rolling) using two round dies 650 and 652 is performed.

Specifically, as shown in FIG. 20, while two round dies 650 and 652 disposed so as to sandwich the pipe member 600 (workpiece) are pressed against the pipe member 600 at a predetermined pressure (direction of the pressure is indicated by the symbol "P" in FIG. 20), the two round dies 650 and 652 are rotated in the same direction (see FIG. 20). In the through feed rolling, due to rotation of the round dies 650 and 652, the pipe member 600 moves in the direction indicated by the symbol "H" in FIG. 20 while rotating in the direction opposite to the rotation direction of the round dies 650 and 652 (see FIG. 20). Convex sections 650*a* and 652*a* for forming a groove 680 are provided respectively on the surface of the round dies 650 and 652. The convex sections 650*a* and 652*a* deform the pipe member 600 to form the groove 680 on the pipe member 600.

After completion of the rolling process, plating is performed on the surface of the central portion 510*a*. In this embodiment, electroless Ni—P plating is employed as the plating. However, there is no limitation to this, and hard chrome plating or electroplating may be employed for example.

Method for Assembling the Yellow Developing Device 54

The method for assembling the yellow developing device 54 is described with reference to FIG. 21.

First of all, the above-described housing 540, holder 526, developing roller 510, regulating blade 560 and the like are prepared (step S2). Next, the regulating blade 560 is fixed to the holder 526 as a result of being fixed to the regulating blade support section 526*c* of the holder 526 with screws (step S4). The aforementioned end portion seal 574 is attached to the regulating blade 560 beforehand ahead of this step S4.

Then, the developing roller 510 is attached to the holder 526 to which the regulating blade 560 is fixed (step S6). At this time, the developing roller 510 is attached to the holder 526 such that the regulating blade 560 contacts against the developing roller 510 through one end portion to the other end portion in the axial direction of the developing roller 510. The aforementioned upper seal 520 is attached to the holder 526 beforehand ahead of this step S6.

Then, the holder 526 to which the developing roller 510, regulating blade 560 and the like are attached, is attached to the housing 540 via the housing seal 546 (step S8), thereby assembly of the yellow developing device 54 is completed. The aforementioned toner supply roller 550 is attached to the housing 540 beforehand ahead of this step S8.

Other Embodiments

An image forming apparatus of the invention, etc. has been described above based on the foregoing embodiment, but the foregoing embodiment of the invention is for the purpose of elucidating the invention and is not to be interpreted as limiting the invention. The invention can of course be altered and improved without departing from the gist thereof and includes functional equivalents.

It should be noted that in the foregoing embodiment, an intermediate image transfer type full-color laser beam printer was described as an example of the image forming apparatus, but the invention can also be adopted for various other types of image forming apparatuses, such as full-color laser beam printers that are not of the intermediate image transfer type, monochrome laser beam printers, copying machines, and facsimiles.

The photoconductor, too, is not be limited to a so-called photoconductive roller, configured by providing a photoconductive layer to an outer circumferential surface on a cylindrical conductive base material, but may be a so-called photoconductive belt, configured by providing a photoconductive layer to a surface on a belt-type conductive base material.

In the foregoing embodiment, as shown in FIG. 3A, the charging member is the rotatable charging roller 31, and the charging roller 31 opposes the photoconductor 20 with a gap therebetween (in other words, the charging roller 31 charges the photoconductor 20 in a non-contacting state with the photoconductor 20). However, there is no limitation to this. For example, the charging roller 31 may charge the photoconductor 20 in contact therewith.

It is known that uneven density is likely to occur due to charging in the case of so-called non-contact charging, in which the charging roller 31 contacts the photoconductor 20 in a non-contacting state. Therefore, the foregoing embodiment is preferable because it can more efficiently achieve the effect of the printer 10 of the present embodiment, in which the cycle T1 of the developing bias and the cycle T2 of the charging bias satisfy the condition of $T1 \neq T2$, namely, the effect of suppressing conspicuous uneven density in images.

Also in the foregoing embodiment, as shown in FIG. 19, the types of media on which images can be formed include plain paper and thick paper. The moving velocity v of the surface of the developing roller 510 is increased (300 mm/s) when forming images on the plain paper while reducing the moving velocity V of the surface of the developing roller 510 when forming images on the thick paper (150 mm/s). However, there is no limitation to this. For example, the moving velocity V of the developing roller 510 may be changed in accordance with installation environments of the printer 10.

When the moving velocity V of the developing roller 510 is changed depending on the type of a medium, the degree of the change tends to be greater since images are formed in accordance with the selected medium. For this reason, the above two expressions (that is, $T1 > Lmin/V$, and $T1 \neq nT2$) can be certainly satisfied by changing the cycle T1 of the developing bias and the cycle T2 of the charging bias in accordance with the moving velocity V of the developing roller 510. As a result, even if the type of the medium is changed, it is possible to appropriately suppress occurrence of the discharge phenomenon and suppress conspicuous uneven density in images. In this regard, the above embodiment is preferable.

In the foregoing embodiment, the concave section is two types of helical groove sections 512 which have different inclination angles with respect to the circumferential direction of the developing roller 510, and the two types of helical groove sections 512 mutually intersect so as to form a grid pattern. However, there is no limitation to this.

For example, the concave section does not need to be groove-shaped. Also, when the concave sections are grooves, the grooves do not need to be in a helical form. In addition, only one type of groove section may be formed as the concave section.

In the foregoing embodiment, the developing roller 510 has the top surface 515 in a rhomboid shape surrounded by the two types of helical groove sections 512, and one of two diagonal lines of the rhomboid-shaped top surface 515 is along the circumferential direction. However, there is no limitation to this.

Figure 22A:
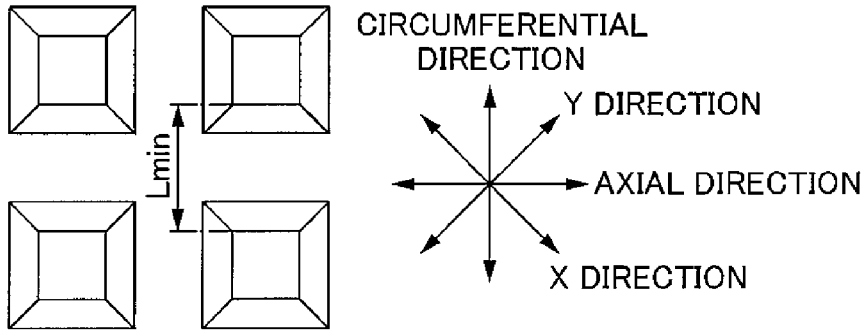
FIG. 22A shows a variation (1) of the surface geometry of the developing roller 510.

For example, as shown in FIG. 22A, it is possible that neither of the two diagonal lines of the rhomboid-shaped top surface is along the circumferential direction.

In the foregoing embodiment, the developing roller 510 has a top surface 515 in a square shape surrounded by the two types of helical groove sections 512. However, there is no limitation to this.

Figure 22B:
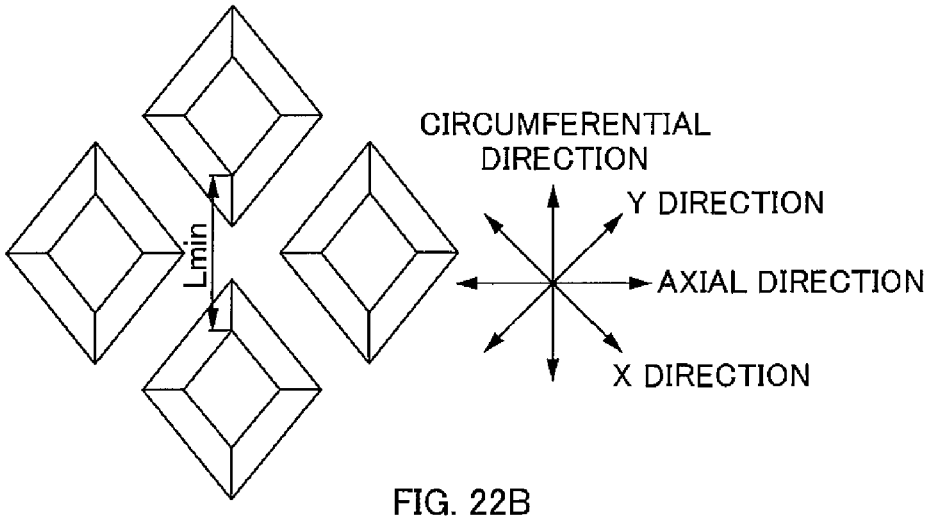
FIG. 22B shows a variation (2) of the surface geometry of the developing roller 510.
Figure 22C:
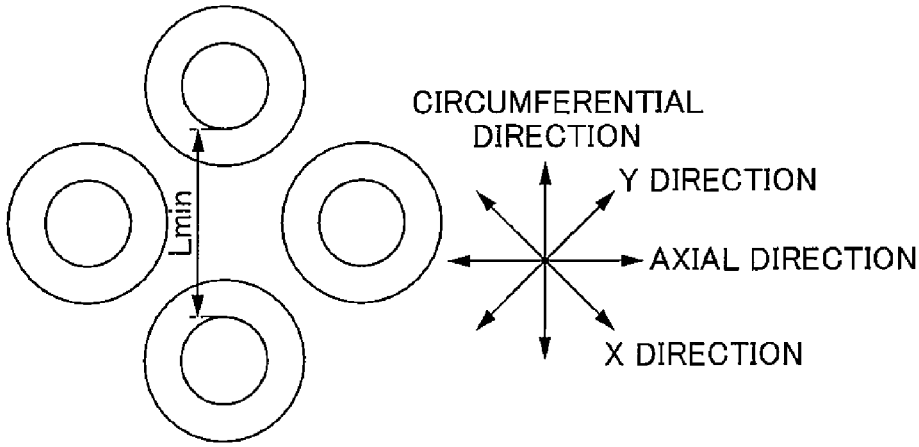
FIG. 22C shows a variation (3) of the surface geometry of the developing roller 510.

For example, as shown in FIG. 22B, the top surface may have a rhomboid shape, which is not a square shape. Further, the top surface may have a circular shape, not a rhomboid shape, as shown in FIG. 22C. FIGS. 22A to 22C show variations of the surface geometry of the developing roller 510 (the above-described minimum width Lmin is indicated in each figure for reference).

In the foregoing embodiment, the groove section 512 includes the bottom face 513 and the side face 514, and the inclination angle of the side face 514 is approximately 45 degrees (see FIG. 8). However, there is no limitation to this. For example, the inclination angle of the side face 514 may be approximately 90 degrees.

In the foregoing embodiment, the voltage that the alternating voltage applying section 132 applies to the developing roller 510 is the first voltage V1 and the second voltage V2 only, and the alternating voltage applying section 132 applies the first voltage V1 and the second voltage V2 alternately. However, there is no limitation to this. For example, the alternating voltage applying section 132 may apply the alternating voltage such as that shown in FIG. 23A.

In the foregoing embodiment, the duty ratio of the alternating voltage is 50%. However, there is no limitation to this, and the alternating voltage such as that shown in FIG. 23B may be applied.

Figure 23A:
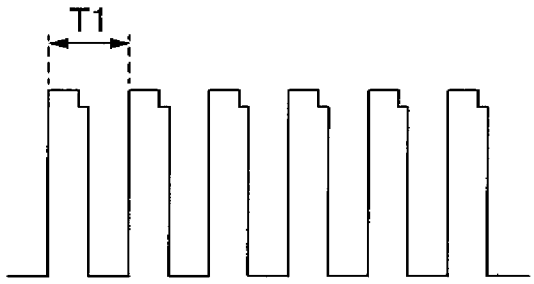
FIG. 23A shows a variation (1) of the developing bias.
Figure 23B:
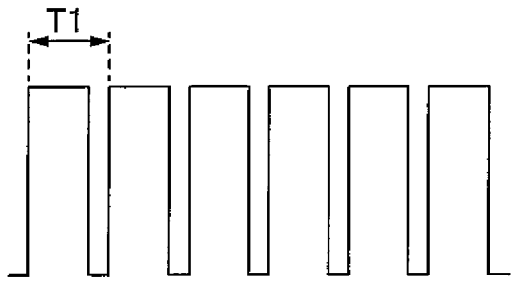
FIG. 23B shows a variation (2) of the developing bias.

FIGS. 23A and 23B show variations of the alternating voltages (the above-described cycle period T1 is indicated in each figure for reference).

Configuration of the Image Forming System, Etc.

Next, an embodiment of an image forming system serving as an example of an embodiment of the invention is described with reference to the drawings.

Figure 24:
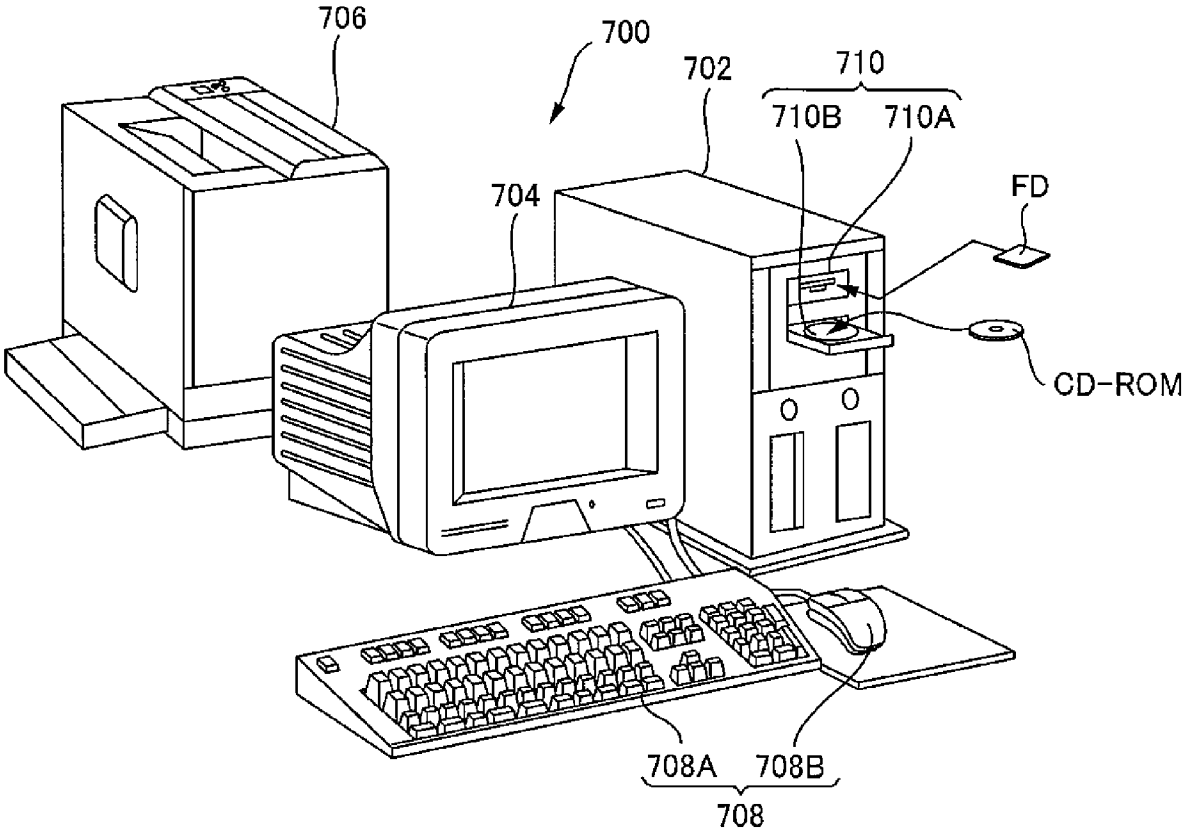
FIG. 24 is an explanatory diagram showing the external structure of an image forming system.

FIG. 24 is an explanatory diagram showing the external structure of the image forming system. An image forming system 700 is provided with a computer 702, a display device 704, a printer 706, an input device 708, and a reading device 710. In this embodiment, the computer 702 is accommodated within a mini-tower type case. However, there is no limitation to this. A CRT (cathode ray tube), a plasma display, or a liquid crystal display device, for example, is generally used as the display device 704, but there is no limitation to this. The printer 706 is the printer described above. In this embodiment, the input device 708 is a keyboard 708A and a mouse 708B, but there is no limitation to these. In this embodiment, a flexible disk drive device 710A and a CD-ROM drive device 710B are used as the reading device 710, but the reading device 710 is not limited to these, and it may also be a MO (magnet optical) disk drive device or a DVD (digital versatile disk), for example.

Figure 25:
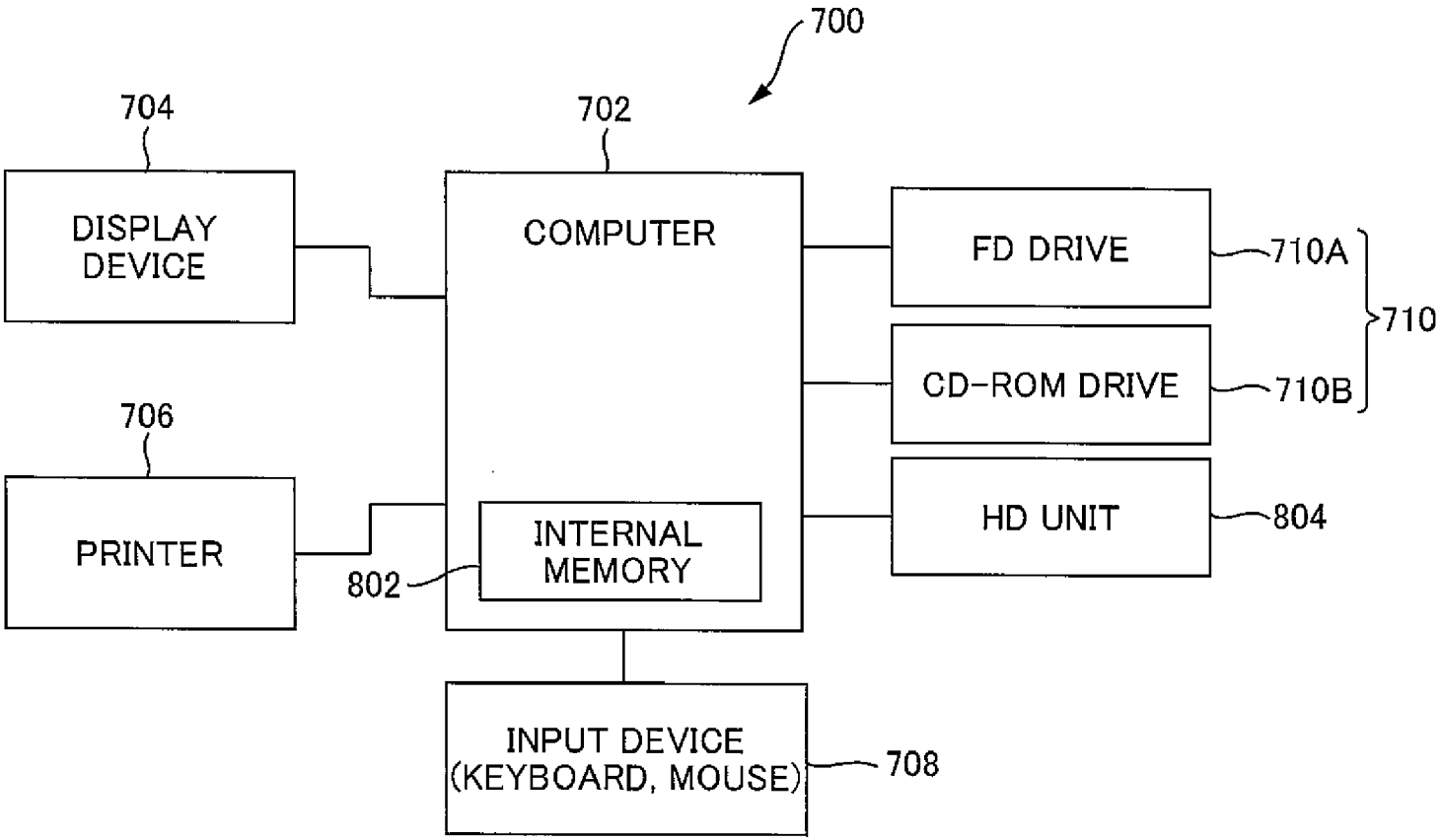
FIG. 25 is a block diagram showing the configuration of the image forming system shown in FIG. 24.

FIG. 25 is a block diagram showing the configuration of the image forming system shown in FIG. 24. An internal memory 802 such as a RAM is provided within the case accommodating the computer 702, and also an external memory such as a hard disk drive unit 804 is provided.

In the above description, an example was described in which the image forming system is constituted by connecting the printer 706 to the computer 702, the display device 704, the input device 708, and the reading device 710, but there is no limitation to this. For example, the image forming system can be constituted by the computer 702 and the printer 706, and the image forming system does not have to be provided with all of the display device 704, the input device 708, and the reading device 710.

It is also possible that, for example, the printer 706 has some of the functions or mechanisms of the computer 702, the display device 704, the input device 708, and the reading device 710. For example, the printer 706 may be configured so as to have an image processing section for carrying out image processing, a display section for carrying out various types of displays, and a recording media attachment/detachment section to and from which recording media storing image data captured by a digital camera or the like are inserted and taken out.

As an overall system, the image forming system that is thus achieved is superior to conventional systems.

What is claimed is:

1. An image forming apparatus comprising:

an image bearing member for bearing a latent image;

a developer bearing member for transporting developer to an opposing position opposing the image bearing member by rotating with developer being borne thereon, the developer bearing member having regularly-disposed concave sections formed on a surface thereof; and an alternating voltage applying section for applying to the developer bearing member an alternating voltage that includes a first voltage for moving developer from the developer bearing member toward the image bearing member and a second voltage for moving developer from the image bearing member toward the developer bearing member in order to develop the latent image using the developer that has been transported to the opposing position, wherein a cycle period of the alternating voltage is larger than a value obtained by dividing a minimum width of the concave section in a circumferential direction of the developer bearing member by a moving velocity of a surface of the developer bearing member during rotation of the developer bearing member, the moving velocity is variable, and when the moving velocity is changed, the cycle period of the alternating voltage is changed so that the cycle period of the alternating voltage is larger than a value obtained by dividing the minimum width by the moving velocity.

2. An image forming apparatus according to claim 1, wherein the concave section is composed of two kinds of helical groove sections that have different inclination angles with respect to the circumferential direction, and the two kinds of helical groove sections mutually intersect so as to form a grid pattern.

3. An image forming apparatus according to claim 2, wherein the developer bearing member includes a rhomboid-shaped top surface surrounded by the two kinds of helical groove sections, and one of two diagonal lines of the rhomboid-shaped top surface is along the circumferential direction.

4. An image forming apparatus according to claim 2, wherein the developer bearing member includes a square-shaped top surface surrounded by the two kinds of helical groove sections.

5. An image forming apparatus according to claim 1, wherein the voltage that the alternating voltage applying section applies to the developer bearing member is only the first voltage and the second voltage, and the alternating voltage applying section alternately applies the first voltage and the second voltage.

6. An image forming apparatus according to claim 1 further comprising:

a charging member opposing the image bearing member, which is for charging the image bearing member; and a superimposed voltage applying section for applying to the charging member a superimposed voltage in which a DC voltage and an AC voltage are superimposed, wherein the cycle period of the alternating voltage is different from both of a value obtained by multiplying a cycle period of the superimposed voltage by any positive integer, and a value obtained by dividing the cycle period by any positive integer.

7. An image forming apparatus according to claim 6, wherein the charging member is a rotatable charging roller, and the charging roller opposes the image bearing member with a gap therebetween.

8. An image forming apparatus according to claim 6, wherein the image bearing member is rotatable, the alternating voltage applying section alternately applies the first voltage and the second voltage for a predetermined period, when a portion of the image bearing member that is positioned at a charging position for charging with the charging member when the superimposed voltage applying section starts applying the superimposed voltage, reaches a developing position for developing using the developer transported to the opposing position through rotation of the image bearing member, the alternating voltage applying section starts applying one of the first voltage and the second voltage to the developer bearing member.

9. An image forming apparatus according to claim 6, wherein the concave section is composed of two kinds of helical groove sections that have different inclination angles with respect to the circumferential direction, and the two kinds of helical groove sections mutually intersect so as to form a grid pattern, the developer bearing member includes a square-shaped top surface surrounded by the two kinds of helical groove sections, and one of two diagonal lines of the square-shaped top surface is along the circumferential direction.

10. An image forming method comprising:

changing a moving velocity of a surface of a developer bearing member during rotation of the developer bearing member, the developer bearing member being for transporting developer to an opposing position opposing an image bearing member by rotating with developer being borne thereon, and including regularly-disposed concave sections formed on the surface thereof, changing a cycle period of an alternating voltage that includes a first voltage for moving developer from the developer bearing member toward the image bearing member and a second voltage for moving developer from the image bearing member toward the developer bearing member so that the cycle period of the alternating voltage is larger than a value obtained by dividing a minimum width of the concave section in a circumferential direction of the developer bearing member by the moving velocity after change, changing a cycle period of a superimposed voltage in which a DC voltage and an AC voltage are superimposed, such that the cycle period after change of the alternating voltage are different from both of a value obtained by multiplying the changed cycle period of the superimposed voltage by any positive integer, and a value obtained by dividing the changed cycle period by any positive integer, charging the image bearing member by applying the superimposed voltage, whose cycle period has been changed, to a charging member opposing the image bearing member, and developing a latent image borne on the image bearing member using the developer that has been transported to the opposing position by applying the alternating voltage, whose cycle period has been changed, to the developer bearing member.

11. An image forming method according to claim 10, wherein types of media on which an image can be formed are plain paper and thick paper, and when an image is formed on the plain paper, the moving velocity of the surface of the developer bearing member is increased, and when an image is formed on the thick paper, the moving velocity of the surface of the developer bearing member is decreased.

12. An image forming system comprising:

a computer; and an image forming apparatus that can be connected to the computer, including an image bearing member for bearing a latent image, a developer bearing member for transporting developer to an opposing position opposing the image bearing member by rotating with developer being borne thereon, the developer bearing member having regularly-disposed concave sections formed on a surface thereof, and an alternating voltage applying section for applying to the developer bearing member an alternating voltage that includes a first voltage for moving developer from the developer bearing member toward the image bearing member, and a second voltage for moving developer from the image bearing member toward the developer bearing member in order to develop the latent image using the developer that has been transported to the opposing position, wherein a cycle period of the alternating voltage is larger than a value obtained by dividing a minimum width of the concave section in a circumferential direction of the developer bearing member by a moving velocity of a surface of the developer bearing member during rotation of the developer bearing member, the moving velocity is variable, and when the moving velocity is changed, the cycle period of the alternating voltage is changed so that the cycle period of the alternating voltage is larger than a value obtained by dividing the minimum width by the moving velocity.

* * * * *